US010383782B2

(12) United States Patent
Rapoport

(10) Patent No.: US 10,383,782 B2
(45) Date of Patent: Aug. 20, 2019

(54) INCUBATOR DEPLOYABLE MULTI-FUNCTIONAL PANEL

(71) Applicant: Aspect Imaging Ltd., Shoham (IL)

(72) Inventor: Uri Rapoport, Moshav Ben Shemen (IL)

(73) Assignee: ASPECT IMAGING LTD., Shoham (IL)

( * ) Notice: Subject to any disclaimer, the term of this patent is extended or adjusted under 35 U.S.C. 154(b) by 167 days.

(21) Appl. No.: 14/619,557

(22) Filed: Feb. 11, 2015

(65) Prior Publication Data

US 2015/0231012 A1 Aug. 20, 2015

Related U.S. Application Data

(60) Provisional application No. 61/940,514, filed on Feb. 17, 2014.

(51) Int. Cl.
*A61G 11/00* (2006.01)

(52) U.S. Cl.
CPC ..... *A61G 11/006* (2013.01); *A61G 11/007* (2013.01); *A61G 11/009* (2013.01); *A61G 2200/14* (2013.01); *A61G 2200/32* (2013.01); *Y10T 29/49826* (2015.01)

(58) Field of Classification Search
CPC ..... A61G 11/006; A61G 11/007; A61G 2200/32; A61G 11/009; A61G 2200/14; Y10T 29/49826
USPC ..... 600/21, 22; 29/428
See application file for complete search history.

(56) References Cited

U.S. PATENT DOCUMENTS

| | | | |
|---|---|---|---|
| 1,900,342 | A | 3/1933 | Hess |
| 2,638,087 | A | 5/1953 | Livsey |
| 2,708,927 | A | 5/1955 | Dixon et al. |
| 3,012,836 | A | 12/1961 | Smith et al. |
| 3,315,671 | A | 4/1967 | Creelman |
| 3,470,866 | A | 10/1969 | Gittelson |
| 3,655,178 | A | 4/1972 | Vezina |

(Continued)

FOREIGN PATENT DOCUMENTS

| | | |
|---|---|---|
| CA | 2815746 | 5/2012 |
| CN | 2448344 | 9/2001 |

(Continued)

OTHER PUBLICATIONS

ANSI/AAMI/IEC 60601-2-20:2009, Medical Electrical Equipment, Part 2-20, Particular Requirements for the Basic Safety and Essential Performance of Infant Transport Incubators, Feb. 20, 2009, Sections 201.3.201 through 201.3.210, The Association for the Advancement of Medical Instrumentation, Arlington, VA, USA.

(Continued)

*Primary Examiner* — Navin Natnithithadha
*Assistant Examiner* — Sunita Reddy
(74) *Attorney, Agent, or Firm* — Pearl Cohen Zedek Latzer Baratz LLP

(57) ABSTRACT

An incubator including a plurality of panels. At least one of the panels, or portion thereof, is a multi functional panel that is reversibly connected to at least one of the plurality of panels. The incubator can be opened and closed. In a closed configuration, the incubator sealingly encloses an internal environment. In an open configuration, the multi-functional panel is deployable as a countertop.

8 Claims, 15 Drawing Sheets

(56) References Cited

U.S. PATENT DOCUMENTS 3,710,791 A 1/1973 Deaton
3,920,000 A 11/1975 Atherton et al.
4,161,172 A 7/1979 Pickering
4,509,505 A 4/1985 Mercey et al.
4,567,894 A 2/1986 Bergman
4,712,263 A 12/1987 Pronzinski
4,750,474 A 6/1988 Dukhan et al.
4,936,824 A 6/1990 Koch et al.
5,059,906 A 10/1991 Yamanaka
5,100,375 A 3/1992 Koch
5,446,934 A * 9/1995 Frazier ..... A61G 11/00 5/421
5,534,669 A 7/1996 Schroeder et al.
5,759,149 A 6/1998 Goldberg et al.
5,797,833 A 8/1998 Kobayashi et al.
5,800,335 A 9/1998 Koch et al.
5,817,003 A 10/1998 Moll et al.
5,917,324 A 6/1999 Leussler
5,943,716 A 8/1999 Chu
5,971,913 A 10/1999 Newkirk et al.
6,036,634 A 3/2000 Goldberg et al.
6,155,970 A 12/2000 Dykes et al.
6,231,499 B1 5/2001 Jones
D446,675 S 8/2001 Straub
6,317,618 B1 11/2001 Livni et al.
6,409,654 B1 6/2002 McClain et al.
6,433,548 B1 8/2002 Furuta et al.
6,471,634 B1 * 10/2002 Dykes ..... A61G 11/00 600/22
6,511,414 B1 1/2003 Hamsund
6,611,702 B2 8/2003 Rohling et al.
6,641,521 B2 11/2003 Kolarovic
6,666,816 B2 * 12/2003 Mountain ..... A61G 11/00 600/22
RE38,453 E 3/2004 Lessard et al.
6,776,527 B1 8/2004 Tybinkowski et al.
6,860,272 B2 3/2005 Carter et al.
6,992,486 B2 1/2006 Srinivasan
7,255,671 B2 8/2007 Boone et al.
7,278,962 B2 10/2007 Lonneker-Lammers
D567,948 S 4/2008 Tierney et al.
7,482,558 B2 1/2009 Koch
7,784,121 B2 8/2010 Ahlman
8,147,396 B2 4/2012 Srinivasan
8,851,018 B2 10/2014 Rapoport et al.
8,896,310 B2 11/2014 Rapoport
2001/0049465 A1 12/2001 Goldberg et al.
2002/0072648 A1 * 6/2002 Dykes ..... A61G 11/00 600/22
2002/0123681 A1 9/2002 Zuk et al.
2002/0143233 A1 10/2002 Donnelly et al.
2002/0173696 A1 11/2002 Kolarovic et al.
2002/0173717 A1 * 11/2002 Rohling ..... A61B 5/0555 600/415
2003/0088175 A1 5/2003 Branch et al.
2004/0030241 A1 2/2004 Green et al.
2004/0034273 A1 2/2004 Boris
2004/0133064 A1 7/2004 Castillon Levano et al.
2004/0186341 A1 9/2004 McDermott
2004/0236174 A1 11/2004 Boone et al.
2004/0236175 A1 11/2004 Boone et al.
2005/0004422 A1 1/2005 Caspary et al.
2005/0020906 A1 1/2005 Seijger et al.
2005/0038314 A1 * 2/2005 Falk ..... A61G 11/00 600/22
2005/0113668 A1 * 5/2005 Srinivasan ..... A61B 5/416 600/411
2006/0079730 A1 * 4/2006 Getsla ..... A61G 11/00 600/22
2007/0232894 A1 * 10/2007 Feenan ..... A61B 5/055 600/410
2008/0163425 A1 7/2008 White
2009/0044335 A1 * 2/2009 Brewin ..... A47D 7/04 5/424
2010/0004502 A1 1/2010 Honma et al.
2010/0010599 A1 * 1/2010 Chen ..... A61F 7/02 607/112
2010/0168502 A1 7/2010 Delaporte et al.
2011/0048424 A1 3/2011 Radko
2011/0162652 A1 3/2011 Rapoport
2011/0186049 A1 3/2011 Rapoport
2011/0113555 A1 5/2011 Smith
2011/0125010 A1 * 5/2011 Vaquero Lopez ... A61B 5/0059 600/427
2011/0160521 A1 6/2011 Khodak et al.
2011/0234347 A1 9/2011 Rapoport
2011/0304333 A1 12/2011 Rapoport
2012/0071745 A1 3/2012 Rapoport
2012/0073511 A1 3/2012 Rapoport et al.
2012/0077707 A1 3/2012 Rapoport
2012/0119742 A1 5/2012 Rapoport
2012/0126814 A1 5/2012 Fischer et al.
2013/0025062 A1 * 1/2013 Esch ..... A47D 13/02 5/655
2013/0079624 A1 3/2013 Rapoport
2013/0109956 A1 5/2013 Rapoport
2013/0237803 A1 5/2013 Rapoport
2013/0150656 A1 6/2013 Falk et al.
2013/0204074 A1 8/2013 Belvar et al.
2013/0204617 A1 8/2013 Kuo et al.
2013/0267765 A1 10/2013 Rapoport
2013/0328559 A1 12/2013 Rapoport
2013/0328560 A1 12/2013 Rapoport
2013/0328563 A1 12/2013 Rapoport
2013/0334439 A1 12/2013 Etters
2014/0003614 A1 1/2014 Levitov et al.
2014/0050827 A1 2/2014 Rapoport
2014/0051973 A1 2/2014 Rapoport et al.
2014/0051974 A1 2/2014 Rapoport et al.
2014/0051976 A1 2/2014 Rapoport et al.
2014/0078301 A1 3/2014 Fazzi et al.
2014/0098934 A1 4/2014 Kondo
2014/0099010 A1 4/2014 Rapoport
2014/0103927 A1 4/2014 Rapoport
2014/0117989 A1 5/2014 Rapoport
2014/0128725 A1 5/2014 Rapoport
2014/0139216 A1 5/2014 Rapoport
2014/0142914 A1 5/2014 Rapoport
2014/0152302 A1 6/2014 Rapoport et al.
2014/0152310 A1 6/2014 Rapoport
2014/0158062 A1 6/2014 Rapoport et al.
2014/0230850 A1 8/2014 Rapoport
2014/0257081 A1 9/2014 Rapoport
2014/0266203 A1 9/2014 Rapoport
2014/0300358 A1 10/2014 Rapoport
2014/0354279 A1 12/2014 Dumoulin et al.
2014/0357981 A1 12/2014 Dumoulin
2014/0364722 A1 12/2014 Dumoulin
2014/0378821 A1 12/2014 Rapoport et al.
2014/0378825 A1 12/2014 Rapoport et al.
2015/0045608 A1 * 2/2015 Karp ..... A47D 15/008 600/28
2015/0065788 A1 3/2015 Rapoport
2015/0137812 A1 5/2015 Rapoport
2015/0141799 A1 5/2015 Rapoport et al.
2016/0030264 A1 * 2/2016 Lehmann ..... A61M 16/161 600/22
2016/0081582 A1 3/2016 Rapoport

FOREIGN PATENT DOCUMENTS

CN 102551719 7/2012
DE 19617739 6/1997
EP 1132072 9/2001
EP 2581071 4/2013
JP 2007252741 10/2007
JP 2010178857 8/2010
WO WO1998048756 11/1998
WO WO9921526 5/1999
WO WO2008137003 11/2008
WO WO2010054457 5/2010

(56) References Cited

FOREIGN PATENT DOCUMENTS

| | | |
|---|---|---|
| WO | WO2011109761 | 9/2011 |
| WO | WO2012143825 | 10/2012 |
| WO | WO2013115847 | 8/2013 |

OTHER PUBLICATIONS

Aspect Imaging Ltd., "Shutting Assembly for Closing an Entrance of an MRI Device", co-pending U.S. Appl. No. 14/540,163, filed Nov. 13, 2014.
Aspect Imaging Ltd, "MRI—Incubator's Closure Assembly", co-pending U.S. Appl. No. 14/539,442, filed Nov. 12, 2014.
Aspect Imaging Ltd., "Cage in an MRD with a Fastening/Attenuating System", co-pending U.S. Appl. No. 14/527,950, filed Oct. 30, 2014.
Rapoport, Uri, "RF Shielding Conduit in an MRI Closure Assembly", co-pending U.S. Appl. No. 14/574,785, filed Dec. 18, 2014.
Aspect Imaging Ltd., "System and Method for Generating Invasively Hyperpolarized Images", co-pending U.S. Appl. No. 14/556,682, filed Dec. 1, 2014.
Aspect Imaging Ltd., "System and Method for Generating Invasively Hyperpolarized Images", co-pending U.S. Appl. No. 14/556,654, filed Dec. 1, 2014.
Aspect Imaging Ltd., "MRI with Magnet Assembly Adapted for Convenient Scanning of Laboratory Animals with Automated RF Tuning Unit", co-pending U.S. Appl. No. 14/581,266, filed Dec. 23, 2014.
Aspect Imaging Ltd., "Chamber for Housing Animals During Anaesthetic Procedures", co-pending U.S. Appl. No. 14/537,266, filed Nov. 10, 2014.
Aspect Imaging Ltd., "RF Automated Tuning System Used in a Magnetic Resonance Device and Methods Thereof", co-pending U.S. Appl. No. 14/588,741, filed Jan. 2, 2015.
Aspect Imaging Ltd., "Means for Operating an MRI Device Within a RF-Magnetic Environment", co-pending U.S. Appl. No. 14/596,320, filed Jan. 14, 2015.
Aspect Imaging Ltd., "Means and Method for Operating an MRI Device Within a RF-Magnetic Environment", co-pending U.S. Appl. No. 14/596,329, filed Jan. 14, 2015.
Aspect Imaging Ltd., "CT/MRI Integrated System for the Diagnosis of Acute Strokes and Methods Thereof", co-pending U.S. Appl. No. 14/598,517, filed Jan. 16, 2015.
Aspect Imaging Ltd., "Mechanical Clutch for MRI", co-pending U.S. Appl. No. 14/611,379, filed Feb. 2, 2015.
Aspect Imaging Ltd., "Method for Providing High Resolution, High Contrast Fused MRI Images", co-pending U.S. Appl. No. 13/877,533, filed May 22, 2014.
Aspect Imaging Ltd., "Method for Manipulating the MRI's Protocol of Pulse-Sequences", co-pending U.S. Appl. No. 14/070,695, filed Nov. 4, 2013.
Aspect Imaging Ltd., "Foamed Patient Transport Incubator", co-pending U.S. Appl. No. 14/531,289, filed Nov. 3, 2014.
Aspect Imaging Ltd., "Incubator Deployable Multi-Functional Panel", co-pending U.S. Appl. No. 14/619,557, filed Feb. 11, 2015.
Aspect Imaging Ltd., "MRI Thermo-Isolating Jacket", co-pending U.S. Appl. No. 14/623,039, filed Feb. 16, 2015.
Aspect Imaging Ltd., 2015 "MRI RF Shielding Jacket", co-pending U.S. Appl. No. 14/623,051, filed Feb. 16, 2015.
Aspect Imaging Ltd., "Capsule for a Pneumatic Sample Feedway", co-pending U.S. Appl. No. 14/626,391, filed Feb. 19, 2015.
Aspect Imaging Ltd., "Incubator's Canopy with Sensor Dependent Variably Transparent Walls and Methods for Dimming Lights Thereof", co-pending U.S. Appl. No. 14/453,909, filed Aug. 7, 2014.
Aspect Imaging Ltd., "Temperature-Controlled Exchangeable NMR Probe Cassette and Methods Thereof", co-pending U.S. Appl. No. 14/504,890, filed Oct. 2, 2014.
Aspect Imaging Ltd., "NMR Extractable Probe Cassette Means and Methods Thereof", co-pending U.S. Appl. No. 14/504,907, filed Oct. 2, 2014.
Antonucci, et al., The infant incubator in the neonatal intensive care unit: unresolved issues and future developments, J. Perinat. Med. 37(2009), 587-598.
Baby Pod II Operation and Maintenance Manual, revision 5, Jan. 2011, pp. 1-11.
Ferris et al., The design of neonatal incubators: a systems-oriented, human centered approach, J. Perinatology, 2013, 33, S24-S31.
Kim et al., Air transparent soundproof window, AIP Advances 4, 117123 (2014), published online, doi: http://dx.doi.org/10.1063/1.4902155.
Knutson, Allysa Jennie, Acceptable noise levels for neonates in the neonatal intensive care unit, A Capstone Project submitted in partial fulfillment of the requirements for the degree of: Doctor of Audiology, Washington University School of Medicine Program in Audiology and Communication Sciences, May 17, 2013, pp. 1-59.
Liu, Lichuan et al., Development and Applications of Active Noise Control System for Infant Incubators, Proceedings of the 2009 IEEE International Conference on Systems, Man, and Cybernetics San Antonio, TX, USA—Oct. 2009, pp. 1-6.
Mahil et al., Hybrid Swarm Algorithm for the Suppression of Incubator Interference in Premature Infants ECG, Research Journal of Applied Sciences, Engineering and Technology 6(16): 2931-2935, 2013.
Marik et al., Neonatal incubators: A toxic sound environment for the preterm infant?, Pediatr Crit Care Med 2012 vol. 13, No. 6. pages 1-6.
Paley et al., An MR-compatible neonatal incubator, The British Journal of Radiology, 85, 2012, 952-958.
American National Standard, Medical Electrical Equipment—Parts 2-19: Particular requirements for the basic safety and essential performance of infant incubators, Association for the advancement of medical instrumentation, ANSI/AAI/IEC 60601-2-19:2009, pp. 1-19.
Ranganna et al., Reducing noise on the neonatal unit, Infant, 2011, vol. 7, Issue 1, pp. 25-28.
Jenkins, S., ScanPod, BabyPod-Products-ScanPod, 2002-2011 Advance Healthcare Technology, ltd., internet website http://babypod.com:80/products/scanpod.php.
Science Daily, Inside the preemie brain, Incubator enables MRI scans on premeeies for preventing birth asphyxia, Dec. 1, 2005, pp. 1-2, Web address: http://web.archive.org/web/20130303154220/http://www.sciencedaily.com/videos/2005/1211-inside_the_preemie_brain.htm.
Kitterman et al., Catheterization of umbilical vessels in newborn infants, Pediatric Clinics of North America, vol. 17, No. 4, Nov. 1970, 895-912.

* cited by examiner

INCUBATOR DEPLOYABLE MULTI-FUNCTIONAL PANEL

FIELD OF THE INVENTION

The present invention generally relates to the field of incubators, and more particularly, to a multi-functional deployable panel of an incubator, providing a life support countertop and methods thereof.

BACKGROUND OF THE INVENTION

Premature babies and health compromised neonates and infants require specialized attentive care. This includes stable appropriate environmental conditions such as temperature and humidity. The newborn are also sensitive to noise, light and excessive vibration. In many cases, the neonates require medical life support to facilitate or monitor breathing, feeding, fluid exchange, body temperature and cardiac activity.

In neonatal intensive care units (NICU), incubators are utilized in order to maintain environmental conditions and provide round the clock support for the premature baby. Incubators are enclosed chambers housing the neonate, comprising a system for controlling its environment, and connecting to medical life support and monitoring equipment.

In order to provide care within the incubator, the handler needs to maintain access to the neonate. From general maintenance functions such as cleaning, tube exchanging, drawing blood samples to life support essential functions such as placing sensors, ventilating equipment and fluid exchange, direct comfortable approach is necessary for proper treatment.

Many times additional treatment is given to neonates during their hospitalization. These include treatments such as MRI, light therapy, blood transfusion, post-surgery care, eye examination, etc. These treatments require access of the medical personal to the neonate, and in many times require extraction of the neonate out of the incubator in order to receive treatment.

Moreover, in situations where the neonate requires immediate emergency treatment, there is need for direct contact to the infant still connected to life support medical equipment.

As the incubator is an enclosed chamber, it is in many cases an obstacle to a quick and efficient approach to the neonate. Further, cumbersome approach to the neonate afflicts on care it is given. In addition, constantly changing the neonate's placement enhances the discomfort of the neonate and further enhances the opportunity for a falling accident. Any placement onto which the neonate is placed should be able to connect to life support equipment or accept the life support equipment already connected to the neonate in order to provide continuity in medical support and prevent health complications.

There is thus a long felt need in the art for an incubator that can be opened to provide direct and comfortable access to the neonate by medical personal, care givers, technicians and chaperons while deploying a life supporting countertop, keeping all of the life support equipment available and active.

Prior art incubators include Delaporte, US20100168502, which disclosed a neonatal care system integrated with a hospital bassinet which is made up of a bassinet bed and a frame. The frame for the bassinet acts as both a structural support system and a means for transportation when the neonatal care incubator is attached at the top of the frame.

The neonatal intensive care system comprising: an infant incubator comprising: a base configured for supporting an infant, the base defining a low profile volume including an open top; and an adjustable hood coupled over the open top of the base, wherein in one configuration the hood collapses completely into the base.

However, the above mentioned incubator cannot supply the life-support environment to the neonate, in its open or collapsed configurations.

Accordingly, there is a need for an incubator that can be opened and deployed to a life supporting countertop, while keeping all of the life supporting equipment active and available.

SUMMARY OF THE INVENTION

The present invention provides an incubator, a method of manufacturing the incubator, and a method for deploying an incubator's panel or a portion thereof into a countertop. The incubator includes n panels, at least one of which or portion thereof is a multi functional panel (MFP), reversibly connected to at least one of the n panels; n is an integer equal to or greater than 3; the incubator is characterized by at least one first CLOSED CONFIGURATION, sealingly enclosing an internal environment of the incubator; and at least one first OPEN CONFIGURATION, in which the MFP is deployable as a countertop.

In some embodiments of the invention, the incubator includes a housing sized and shaped to accommodate a neonate. The incubator housing encloses an internal environment.

In some embodiments of the invention, the incubator includes life support equipment. At least a portion of the life support equipment is integrated into at least one or a portion thereof selected from: the n panels, the MFP or any combination thereof. The MFP is integrated into at least one of the n panels, when in the closed configuration. The MFP is layered on at least one of the n panels, when in the closed configuration.

In some embodiments of the invention, the incubator, in the closed configuration, encloses a neonate in an internal environment. In some embodiments of the invention, the incubator includes an internal environmental control means. The internal environmental control means can include means for controlling the incubator internal environment's temperature regulating, ventilation, light, sound transmission, vibration, humidity, drift, movement or any combination thereof. The means for controlling the incubator internal environment temperature can induce a homogenized temperature throughout the incubator inner environment. The means for controlling the incubator internal environment can be connected to a user interface. The means for controlling the incubator internal environment can be embedded within the incubator. The means for controlling the incubator internal environment are remotely controlled.

In some embodiments of the invention, the open configuration forms an open environment incubator.

In some embodiments of the invention, the life support is configured to remain operating and connected to the neonate, the incubator or both during transition of the incubator between configurations, and additionally or alternatively while in both closed configuration opened configuration or both.

In some embodiments of the invention, the MFP is maneuverably connected to the incubator by a mechanism selected from a hinge mechanism, a pivot point mechanism, a sliding mechanism, telescopic mechanism, a magnetic attachment mechanism or any combination thereof.

In some embodiments of the invention, the MFP is reversibly connectable to another apparatus selected from an operating table, a stretcher, a gurney, a cart, a bed, a crib, an imaging device, a transport incubator, a treatment table or any combination thereof.

In some embodiments of the invention, the MFP is deployable to a planar surface selected from a horizontal surface, a vertical surface, an angled surface or any combination thereof.

In some embodiments of the invention, the MFP includes at least two sections. In some embodiments of the invention, at least a section of the MFP is deployable to a planar surface selected from a horizontal surface, a vertical surface, an angled surface or any combination thereof. In some embodiments of the invention, the MFP sections are maneuverably connected therebetween by a mechanism selected from a hinge mechanism, a pivot point mechanism, a sliding mechanism, a telescopic mechanism, a magnetic attachment mechanism or any combination thereof.

In some embodiments of the invention, the MFP includes side bars. In some embodiments of the invention, the incubator includes side bars which are maneuverably connected to the MFP.

In some embodiments of the invention, the MFP includes at least one support connecting the MFP to an element selected from the incubator, an incubator's cart, the ground, a vertical wall, a transport vehicle, an imaging system, or any combination thereof. In some embodiments of the invention, the MFP support is foldable.

In some embodiments of the invention, at least a portion of the MFP includes at least partially transparent material.

In some embodiments of the invention, the MFP includes at least one opening. The MFP opening includes a closable door. The incubator door may be sized and shaped to provide access to the neonate. The MFP opening is sized and shaped for the passage of life support equipment. The MFP opening is sized and shaped for the passage of a handler's hand. The MFP opening may be sized and shaped for the passage of medical equipment tubing. The MFP opening is connected to an element selected from a container, a tube, ventilation equipment, a life supporting element, viewing equipment, a temperature regulating system, waste disposal, or any combination thereof.

In some embodiments of the invention, at least a portion of the MFP is connected to life support equipment. In some embodiments of the invention, the MFP includes at least one life support element. At least a portion of the life support element is accommodated within the incubator.

In some embodiments of the invention, the MFP includes a temperature regulating system. The temperature regulating system regulates the temperature of the MFP, the incubator, a neonate, the incubator's inner volume or any combination thereof.

In some embodiments of the invention, at least a portion of the MFP includes at least one sterilizable material. The incubator can include at least a portion of sterilizable material.

In some embodiments of the invention, the incubator includes at least a portion of disposable material. The incubator may be a one time use disposable incubator.

In some embodiments of the invention, the incubator is foldable.

In some embodiments of the invention, the MFP is a modular panel or portion thereof, interchangeable according to need. The incubator may be constructible of modular pieces.

In some embodiments of the invention, the incubator is reversibly connected to a mobile cart. At least a portion of the MFP is reversibly connected to a mobile cart.

In some embodiments of the invention, at least a portion of the incubator includes MRI safe material.

In some embodiments of the invention, the incubator includes an ergonomic placement for at least a portion of a neonate. The incubator may include bedding for a neonate. The incubator includes a means to secure a neonate within the incubator. The incubator includes a means to secure a neonate on top the MFP.

In some embodiments of the invention, the incubator may include an alarm system.

In some embodiments of the invention, the MFP includes at least one sensor selected from a temperature sensor, a humidity sensor, a respiratory rate sensor, a weight sensor, a pressure sensor, a vibration sensor, a gas concentration sensor, a movement sensor, a sensor to detect closed or opened configuration of the incubator or any combination thereof.

In some embodiments of the invention, the incubator includes at least one sensor. The sensor is connected to a CPU, an alarm system, a user interface, life support equipment, at least one indicator or any combination thereof.

In some embodiments of the invention, the incubator includes a latching mechanism configured to secure the incubator in a closed or opened configuration.

In some embodiments of the invention, the incubator includes at least one mechanism connected to at least a portion of the MFP. The at least one mechanism configured to transform at least one first open configuration to at least one first closed configuration, at least one closed configuration to at least one open configuration, or both.

In some embodiments of the invention, the opening mechanism is an emergency opening mechanism. The mechanism is selected from a manual mechanism, an automatic mechanism, or any combination thereof.

In some embodiments of the invention, the MFP includes a lighting system. The lighting system includes at least one mode of lighting for each configuration of the incubator. The lighting system includes at least one first lighting mode for within the incubator enclosed environment and at least one first lighting mode for the incubator from the outside. The lighting system is maneuverable. The lighting system is manually operable, automatically operable or both. The lighting system includes at least two light spectrums, at least two intensities, or both. The lighting system is connected to the incubator, the MFP, CPU, an alarm system, an interlock mechanism, a user interface, a power supply, or any combination thereof.

In some embodiments of the invention, an interlock mechanism is connected to the incubator, the MFP, a CPU, a user interface, an alarm system, an opening mechanism, a closing mechanism or any combination thereof. The mechanism is set to prevent closure of the incubator when detecting a condition such as a protrusion of an object or body portion from within the incubator to the outside through the opening or contrariwise, receiving predetermined signal from life support equipment, when structural integrity of incubator or other incubator portion is compromised, or any combination thereof.

In some embodiments of the invention, the MFP includes at least one indicator selected from a visual indicator, an auditable indicator, a sensible indicator or any combination thereof.

In some embodiments of the invention, the MFP includes a placement for an element selected from life support equipment, medical tools, disposable waste, medical tubing, disposable mattress, cleaning and disinfecting equipment, or any combination thereof.

In some embodiments of the invention, the MFP is reversibly connectable to another apparatus selected from an operating table, a stretcher, a gurney, a cart, a bed, a crib, an imaging device, a transport incubator, a treatment table or any combination thereof.

In some embodiments of the invention, the MFP includes an emergency release mechanism configured to release a neonate from the incubator in one step.

In some embodiments of the invention, the MFP is connected to a power supply selected from an external power supply, an internal power supply or any combination thereof.

In some embodiments of the invention, the incubator includes a CPU configured to control a component selected from a user interface, an alarm system, an opening mechanism, a closing mechanism, a lighting system, a life support element, an interlock mechanism, a temperature regulating system, a ventilation system, a power supply, at least one indicator or any combination thereof. The CPU is connected to a component selected from a user interface, an alarm system, an opening mechanism, a closing mechanism, a lighting system, a life support element, an interlock mechanism, a temperature regulating system, a ventilation system, a power supply, at least one indicator or any combination thereof. The incubator CPU may be connected to an element selected from a group consisting of: at least one sensor, a user interface, temperature regulating system, ventilating system, humidifying system, lighting system, life support equipment, a power supply, an alarm, at least one indicator and any combination thereof.

In some embodiments of the invention, the incubator or MFP includes a remote control mechanism which controls a component selected from an opening mechanism, a closing mechanism, a CPU, lighting, a temperature regulating system, life support equipment, a ventilating system, an alarm system, a power supply, or any combination thereof.

In some embodiments of the invention, the incubator includes a user interface. At least a portion of the user interface is integrated into at least one of the n panels, the MFP or any combination thereof. The user interface is connected to a component selected from the MFP, life support equipment, at least one sensor, a CPU, a power supply, a temperature regulating system, a lighting system, at least one indicator, a display, or any combination thereof.

In some embodiments of the invention, the incubator includes an alarm system. The alarm system is connected to a component selected from the MFP, at least one sensor, at least one indicator, a user interface, a CPU, an interlock mechanism, life support equipment or any combination thereof.

In some embodiments of the invention, the MFP includes a handle.

In some embodiments of the invention the incubator is sized and shaped for insertion to an MRI apparatus for imaging. The open configuration may provide access to the neonate.

In some embodiments of the invention, the deployment of the incubator from an open configuration to a closed configuration immovably maintains an accommodated neonate.

In some embodiments of the invention, the incubator includes multiple panels, of which at least one panel is a multifunctional panel (MFP) having at least one life support element, providing the incubator with at least a closed configuration providing a closed environment incubator and an deployable open configuration into a life supporting countertop.

In some embodiments of the invention, the incubator includes at least one opening and closing mechanism, the mechanism is connected to at least a portion of the MFP, and to at least a portion of at least a second of the n incubator panels. The mechanism is configured to maneuver the MFP such that the incubator is provided with the at least one first open configuration and the at least one first closed configuration.

In some embodiments of the invention, the incubator includes at least one collapsible column, useful for supporting the MFP. The column includes an elongated member having at least two opposite ends. At least one first end is maneuverably connected to the MFP, and at least one second end is reversibly connected to an element selected from a group consisting of: a cart, a storage unit, a transport device, a wall, the floor, an imaging apparatus, a treatment table, and any combination thereof.

The column is configured to be normally deployed when the incubator is in an open configuration. The column is connected to a mechanism configured to close the MFP when column is collapsed.

In some embodiments of the invention, the incubator may include a collapsible column connected to the MFP by a mechanism configured to collapse the column when the incubator is in a closed configuration. The column is collapsible upon application of horizontal force in the axis of at least partial interception of the incubator within an MRD, a medical treatment device, a transport device or any combination thereof. The column is connected by a reversible connection, a maneuverable connection or both. The column is foldable or retractable. The column is of a shape selected from round, multifaceted, geometric, non-geometric, compound shape, or any combination thereof. The column includes a plurality of interconnected pieces.

In some embodiments of the invention, the incubator includes at least one mechanism connected to at least a portion of the MFP. The at least one mechanism configured to transform at least one first open configuration to at least one first closed configuration, at least one closed configuration to at least one open configuration, or both. The mechanism includes horizontal movement means, thereby enabling closing or opening of a sliding mechanism. The mechanism includes rotating movement means around a pivot point. The mechanism includes a magnetic opening and closing means. The mechanism includes an electromagnetic lock.

In some embodiments of the invention, the incubator or MFP includes at least a portion of an external face exposed to the external environment and at least a portion of an internal face exposed to the internal environment. The mechanism is a concealed mechanism, a mechanism mounted on at least a portion of the external face of the incubator, a mechanism mounted on at least a portion of the internal face of the incubator, a mechanism at least partially embedded within at least a portion of the MFP, a mechanism at least partially embedded within at least a portion of the incubator, or any combination thereof.

In some embodiments of the invention, the mechanism is a normally closed mechanism, thereby maintaining the incubator in a closed configuration when in a resting position. In some embodiments of the invention, the mechanism is a normally opened mechanism, thereby maintaining the incubator in an open configuration when in a resting position.

In some embodiments of the invention, the incubator includes a movement sensor, a electromagnetic signal receiving device, an infrared sensor, a light sensor, a sound sensor, a contact sensor, a thermal sensor, an RF sensor, a receiver, a blue tooth technology device, Wi-Fi, Li-Fi, a data receiving device, or any combination thereof.

In some embodiments of the invention, the MFP is connected to the incubator by at least one living hinge.

In some embodiments of the invention, the mechanism includes a push to open mechanism, a push to close mechanism, a self-closing mechanism, a soft closing mechanism, a soft opening mechanism, or any combination thereof.

In some embodiments of the invention, the incubator includes a plurality of sliding mechanism for each the MFP. The mechanisms are interconnected so as to provide simultaneous movement, when the incubator transforms between the opened and closed configurations.

In some embodiments of the invention, the incubator includes a plurality of MFPs, and maneuvering at least one first MFP, results in maneuvering of at least one second MFP.

In some embodiments of the invention, the MFP includes at least a portion of a flexible flap.

In some embodiments of the invention, the incubator includes a base, and at least one belt surrounding at least a portion of the incubator horizontal circumference, and at least a portion of the MFP. The belt is configured to have at least one first position at least partially adjacent to the incubator base, and at least one second position vertically elevated from first position. The belt is at least partially moveable along a vertical axis of the incubator, thereby transforming the incubator between a closed and open configuration.

In some embodiments of the invention, the incubator is connected to a mobile cart containing at least a portion of the mechanism.

In some embodiments of the invention, the incubator includes a plurality of MFP's, at least one opening mechanism, closing mechanism, or both, connected to each MFP. At least two of the maneuvering systems are interconnected to at least one bar. The bar is further interconnected to a main moveable shaft having a protrusion external to the incubator. The moveable shaft is configured to maneuvering the connected MFP's thereby closing or opening the incubator.

In some embodiments of the invention, the mechanism is configured to have a controlled soft closure mechanism. The mechanism is manual, automatic, or any combination thereof. The mechanism is connected to a power supply selected from AC, DC or any combination thereof.

In some embodiments of the invention, the incubator alternates between the open configuration to a closed configuration by a remote control mechanism.

In some embodiments of the invention, the opening mechanism is an emergency opening mechanism. The mechanism includes an interlock mechanism.

BRIEF DESCRIPTION OF THE DRAWINGS

In the following detailed description of the preferred embodiments, reference is made to the accompanying drawings that form a part hereof, and in which are shown by way of illustration specific embodiments in which the invention may be practiced. It is understood that other embodiments may be utilized and structural changes may be made without departing from the scope of the present invention. The present invention may be practiced according to the claims without some or all of these specific details. For the purpose of clarity, technical material that is known in the technical fields related to the invention has not been described in detail so that the present invention is not unnecessarily obscured. In the accompanying drawing:

DETAILED DESCRIPTION OF THE SPECIFIC EMBODIMENTS

Figure 1A:
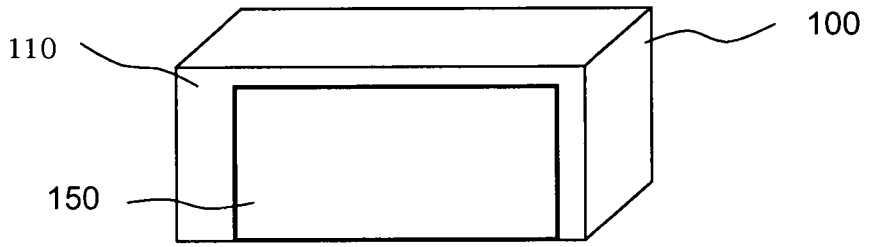
FIGS. 1A and 1B are schematic illustrations of an embodiment of a deployable MFP in an incubator, providing closed and opened configurations.

In the following detailed description of the preferred embodiments, reference is made to the accompanying drawings that form a part hereof, and in which are shown by way of illustration specific embodiments in which the invention may be practiced. It is understood that other embodiments may be utilized and structural changes may be made without departing from the scope of the present invention. The present invention may be practiced according to the claims without some or all of these specific details. For the purpose of clarity, technical material that is known in the technical fields related to the invention has not been described in detail so that the present invention is not unnecessarily obscured.

The essence of the present invention is to provide a deployable incubator, comprising multiple panels, at least one of which or portion thereof is a multi-functional panel (MFP), reversibly connected to at least one of the panels; the incubator is characterized by at least one first CLOSED CONFIGURATION, sealingly enclosing an internal environment of the incubator; and at least one first OPEN CONFIGURATION, in which the MFP is deployable as a countertop.

Further this invention provides a multi-functional panel (MFP), reversibly connectable to an incubator or a panel thereof, providing the incubator with a closed configuration in which the incubator and MFP sealingly enclose an internal environment and deploys into an open configuration with a countertop.

The term "incubator" interchangeably refers hereinafter to a special unit specializing in the care of ill or premature newborn infants. This includes a stationary incubator, a moveable incubator, a transport incubator, a disposable incubator, a healthcare facility incubator, portable incubator, an intensive care incubator, an incubator intended for home use, an incubator for imaging a neonate, a treatment incubator, a modular incubator, an isolating incubator and any combination thereof. The neonatal incubator is a box-like enclosure in which an infant can be kept in a controlled environment for observation and care. The incubator usually includes observation means to observe the accommodated neonate, and openings for the passage of life support equipment, and the handler's hands.

The term "closed environment incubator" interchangeably refers hereinafter to an enclosed environment for the neonate. The closed environment is at least partially isolated from the external environment conditions such as noise, vibration, drift, temperature, light, gas concentrations, humidity, microorganisms, etc. The closed environment can be controlled by environment control systems such as temperature regulating, ventilating, humidifying, lighting, moving, noise reduction systems, vibration reducing systems, etc. The closed environment enclosure prevents passage of micro-organisms.

The term "opened configuration", in reference to the deployable neonate incubator (INCUBATOR), interchangeably refers hereinafter to a deployed state of the incubator in which the neonate is exposed at least in part to the conditions of the external environment.

The term "panel" interchangeably refers hereinafter to a wall, wainscot, ceiling, door, shutter, fence, face, façade, screen, enclosure, surface, barricade, barrier, rampart, retainer, side, fortification, seal, block, partition, blockade, dam, curtain, trench, board, etc., or a distinct portion, section, or division thereof, etc.

The term "hinge" interchangeably refers hereinafter to any maneuverable connection for rotational motion between the current invention parts, portions and modules, such as a flexible mechanism or material, joint, hook, thread, axis, juncture, fold, bend, elbow, knee, corner, fork, axis, pole, ball and socket, condyloid joint, mechanical device, fold hinge, joint, bearing, barrel hinge, pivot hinges, butt/mortise hinges, case hinges, continuous hinges, piano hinges, concealed hinges, cup hinge, euro hinge, butterfly hinges, parliament hinges, dovetail hinges, flag hinges, flag hinge, strap hinges, H hinges, HL hinges, counter-flap hinge, flush hinge, coach hinge, rising butt hinge, double action spring hinge, tee hinge, friction hinge, security hinge, cranked hinge, lift-off hinge, self-closing hinge, butt hinge, butler tray hinge, card table hinge, drop leaf table hinge, floating hinge, living hinge, and any combination thereof.

The term "pivot pin" interchangeably refers hereinafter to any maneuverable connection for rotational motion between the current invention parts, portions and modules at least partially around a pivot point.

The term "track", interchangeably refers hereinafter to such as a track, guide, path, groove, rail, line, route, duct, channel, passage, course, trail, lineament, lane, road, seam, length, axis, tract, pathway, course, highway, roadway, alley, artery, avenue, boulevard, clearing, cut, drag, thoroughfare, trajectory, walk, track way, belt, swath, glider, circuit, stretch, runway, caterpillar track, half-track, flat track, soft close track, pivoted sliding track, adjustable track, etc. Further this track maybe a physical or a virtual motion path along which a maneuverable portion is moved.

The term "sliding mechanism", interchangeably refers hereinafter to a mechanism in which a body is movable in a sliding motion along a track. A portion of the movable body is mounted on, suspended from, inserted to, threaded to, interweaved with, integrated to, fitted to, following, etc. a track. In reference to a physical track, the connection of the moveable portion to the track is directly by geometrical shape fit of on part with the other and/or via a third element such as wheels, rack wheels, ball bearings, rollers, rolling discs, lubricant, location guide, belts, pulleys etc. In reference to a virtual motion track, the movable portion is connected to a sliding motion providing mechanism such as telescopic arms, folding arms, arms, angled arms, etc. connected at a pivotal point, allowing for sliding movement along a predefined virtual path. In addition this sliding mechanism may enable straight sliding, curved sliding, folding slide, sliding around a corner, rolling door sliding, etc.

The term "neonate" or "patient" interchangeably refers herein after to a term selected from a group of: patient, neonate, baby, infant, toddler, child, adolescent, adult, elderly, etc.; further this term refers to person or animal.

The term "handler" interchangeably refers herein after to any person that is in contact with the incubator such as medical personal, maintenance personal, parent, chaperon and technician.

The term "bar" interchangeably refers hereinafter to a peace of matter acting as a blockade that may be a panel, rod, bar, plank, wire, etc., attached to at least a portion of the incubator or MFP. The bar can prevent fall of the neonate or equipment from the incubator or MFP, assist the handler being a hand grip, function as a stand for the placement of external objects, and any combination thereof.

The term "opening mechanism" or "closing mechanism" interchangeably refers hereinafter to a device designed to transform input forces and movement into opening or closing the incubator. This device may be automatic or manual.

The term "automatic" in respect to the movement of a part, a portion and/or a module of the incubator or MFP interchangeably refers herein after to a pre-defined movement having a start location and an end location. Further this movement could be derived from an engine, a self-sliding movement when a latching mechanism is released, pneumatic mechanism (compressed from the self-sliding movement), hydraulic cylinder, using a gear shift system, etc.

The term "manual" in respect to the movement of a part, a portion and/or a module of the incubator or MFP interchangeably refers herein after to any application of force by the handler aimed at maneuvering at least a portion of the incubator or MFP. This force is generated by an action such as pushing, pulling, lifting, levering, turning, twisting, hitting, lowering, etc.

The term "countertop" interchangeably refers hereinafter to at least a partially planar surface, stable and useful as a functional object selected from a group consisting of: a treatment bed, a treatment table, an extra surface, a hand rest for the handler, a medical tray, a shelf, housing for life support equipment, medical equipment tubing, housing for systems (such as power supply, temperature regulating system, ventilating system), housing for user interface (including a display, indicators, control buttons for connected systems or monitors), at least partially perpendicular surface, a hanging device. This surface can be kept in the same sterile and temperature conditions as the incubator.

The term "emergency release mechanism", interchangeably refers hereinafter to a mechanism used in immediate need of extracting a neonate from the incubator that allows in one step the dislocation of at least a portion of the incubator providing access to the neonate.

The term "visual indicators" interchangeably refers hereinafter to a representation of light in the visible light range of about 380 nanometers to about 740 nm. More generally the terms refer to any light within the visible range that will be noticeable by the user of the invention (light, flashing light, flickering light, blinking light, change of spectrum of colors of light etc.).

The term "audible indicators" interchangeably refers hereinafter to a representation of sound, typically as an electrical voltage. Audible indicators have frequencies in the audio frequency range of roughly 20 to 20,000 Hz (the limits of human hearing). Audible indicators are either synthesized directly, or originate at a transducer such as a microphone, musical instrument pickup, phonograph cartridge, or tape head.

The term "sensible indicators" interchangeably refers hereinafter to a physical movement of at least a portion of the user interface, which is noticeable to the user (shaking, vibrating, quivering, etc.).

The term "ergonomic" interchangeably refers hereinafter to the design of the incubator to minimize discomfort of the neonate, handler or both. The incubator is designed in a manner that fits the neonate's body and its cognitive needs and abilities. More specifically this term relates to the placement within the inner volume of the incubator to be fitting by means of size, shape, surface properties, sound transmission, light transmission, etc., to be appropriate for maximizing the well-being of the neonate. This term further relates to the human interface of the incubator designed for the handler, parts such as the user interface, open and close mechanisms, overall size and shape, handles, accessibility to the neonate, connections to other equipment, etc., are all designed in a manner that takes into consideration human factors.

The term "life supporting equipment" interchangeably refers hereinafter to any element that provides an environmental condition, a medical condition or monitoring of an environmental or medical condition thereof that assists in sustaining the life of a neonate or bettering their physical and physiological wellbeing. This element can be: (a) any medical equipment: all devices, tubes, connectors, wires, liquid carriers, needles, sensors, monitors, etc., that are used by medical personal in association with the patient. This equipment is such as bilirubin light, an IV (intravenous) pump, oxygen supplementation systems by head hood or nasal cannula, continuous positive airway pressure system, a feeding tube, an umbilical artery catheter, a fluid transport device, hemofiltration system, hemodialysis system, MRI contras solution injection, imaging the neonate etc.; (b) medical measurement and observation systems (including sensors and/or monitors) of temperature, respiration, cardiac function, oxygenation, brain activity such as ECG (electrocardiography) monitor, blood pressure monitor, cardio-respiratory monitor, pulse oximeter; and (c) environmental control systems such as ventilator, air conditioner, humidifier, temperature regulator, climate control systems, noise muffling device, vibration muffling device, etc. and any combination thereof.

The term "medical equipment tubing" interchangeably refers hereinafter to all tubes, cables, connectors, wires, liquid carriers, gas carriers, electrical wires, monitoring cables, viewing cables, data cables, etc., that is used in connection to life support equipment, medical equipment or physical environment maintenance or monitoring.

The term "placement" interchangeably refers hereinafter to a predefined location for placing one or more Item. This is achieved by a mean such as a clip, anchor, catch, clasp, strip, nest, socket, tray, dent, duct, channel, bridge, clamp, harness, concave shape, crater, gap, pocket, cavity, grip, belt, catch, snap, fastener, hook, hold, support, buckle, latch, lock, hasp, affixer, binder, joiner, band, ring, string, tie, link, chain, fastener, draw latch, lock, bolt, grip, bar, bond, clasp, connection, fixture, buckle, pin, peg, grapnel, band, pin, insertion, label designation etc.

The term "interlock mechanism" interchangeably refers hereinafter to a mechanism used to help prevent incubator from harming the handler, neonate, medical equipment or damaging itself by stopping the movement of the incubator parts portions or modules or the MFP parts portions or modules when a body is detected in the movement range.

The term "magnetic resonance device" (MRD), specifically applies hereinafter to any Magnetic Resonance Imaging (MRI) device, any Nuclear Magnetic Resonance (NMR) spectroscope, any Electron Spoint Resonance (ESR) spectroscope, any Nuclear Quadruple Resonance (NQR) or any combination thereof. The term, in this invention, also applies to any other analyzing and imaging instruments comprising a volume of interest, such as computerized tomography (CT), ultrasound (US) etc. The MRD hereby disclosed is optionally a portable MRI device, such as the ASPECT-MR Ltd commercially available devices, or a commercially available non-portable device.

The term "user interface" interchangeably refers hereinafter to at least one defined area in which the user interacts with the incubator or MFP. This area harbors elements such as: passage for medical equipment, display, CPU, alarm system, monitoring system, power supply, open mechanism, close mechanism, visual indicators, auditory indicators, sensible indicators, handles, etc. The user interface is designed for the handler, neonate or both.

The term "latching mechanism" interchangeably refers hereinafter to a mechanism such as: fastener, draw latch, latch, lock, belt, bolt, grip, bar, bond, clamp, clasp, connection, fixture, link, hook, hasp, buckle, brake, harness, clip, snap, pin, peg, grapnel, lock, brake mechanism, point insertion, etc., that is able to lock the configuration of a maneuverable part in respect to another part.

The term "environmental control means" interchangeably refers hereinafter to means to manage and regulate the physical conditions of a predefined area. The physical conditions are such as temperature, radiation, sound, light, ventilation, gas concentration, humidity, movement, texture and softness of materials, etc. These means are either passive (such as isolating materials, refractive materials, filtering materials, etc.), active (such as temperature regulating system, ventilation system, lighting system, sound muffling, sound transmitting, vibration shock absorbers, humidifying, moving, tilting, rocking).

The term "temperature regulating system" interchangeably refers hereinafter to a system that controls the temperature either by heating or by cooling or both. More specifically the term relates to an air conditioned system, an infrared heater, a water/oil-heated radiator, a coiled heater, an open coil air heater, a round open coil air heater, a convection heater, straight or formed tubular heaters, a quartz tube air heater, a capacitor-type heater, a Pelletier module, a refrigerator, vent, etc.

The term "lighting system" interchangeably refers hereinafter to a system that provides lighting to the MBP, to the incubator, to the handler, and any combination thereof. The lighting system can provide a different light spectrum in different locations for example the inner volume of the incubator and the outer environment. Further, this lighting system can be maneuvered manually or automatically to act as spot lights to a specific direction. This system can be configured to have at least two modes, relating to the opened or closed configurations of the incubator. The lighting can be variable in its lighting spectrum wave length (300-1100 nm), the infrared wave length (700 nm-1 mm), the UV wave length (400 nm and 10 nm), and luminous intensity (lm/sr).

The term "power supply" interchangeably refers hereinafter to a source of power such as electrical power generated from internally supplied DC, externally supplied AC or DC, or both.

The term "transparent material" interchangeably refers hereinafter to materials that enable at least a partial see though, such as, poly-methyl methacrylate, thermoplastic polyurethane, polyethylene, polyethylene terephthalate, isophthalic acid modified polyethylene terephthalate, glycol modified polyethylene terephthalate, polypropylene, polystyrene, acrylic, polyacetate, cellulose acetate, polycarbonate, nylon, glass, polyvinyl chloride, etc. Further in some embodiments at least a portion of this material is imbedded with non-transparent materials for means of strength and/or conductivity such as metallic wires.

The term "connected" in reference to the INCUBATOR, MFP, parts and connecting elements or components thereof, interchangeably refers hereinafter to any contact, relation, association, integration, interconnection, joining, inserting, sewing, welding, interweaving, placing, nesting, layering, placing akin, linkage, unity, alliance, bracketed, combination, coupling, banding, bonding, affiliation, fitting, pairing, attachment, hooking, hinging, welding, adhering, fusion, fixing, tying, sewing, embedding, weaving, etc., of incubator, MFP, parts and connecting elements or components thereof, to each other and to a third party.

The term "CPU", central processing unit, interchangeably refers hereinafter to the hardware within a computer that carries out the instructions of a computer program by performing the basic arithmetical, logical, and input/output operations of the system.

The term "sensor" interchangeably refers hereinafter to any device that receives a signal or stimulus (heat, pressure, light, motion, sound, humidity etc.) and responds to it in a distinctive manner.

The term "modular" interchangeably refers hereinafter to an incubator or panel thereof, which is subdivided into smaller parts (modules) that can be independently created and then used in different embodiments and configurations to drive multiple functionalities.

The term "open environment incubator" interchangeably refers hereinafter to an incubator that comprises at least a partially open shape, thereby creating direct contact between the internal environment of the incubator and the outside world. This formation of an incubator can, in an embodiment, still maintains the function of life support equipment and/or environment control equipment.

The term "belt" interchangeably refers hereinafter to a band of material flexible or not, for at least partially encircling at least a portion of the incubator such as a band, strip, stripe, supporting band, ribbon, ring, strap, string, cincture, cummerbund, girdle, sash, waistband, bandage, bandeau, belt, binding, bond, braid, cable, chain, circle, circuit, copula, cord, fillet, harness, hoop, ligature, line, link, manacle, ribbon, ring, rope, sash, scarf, shackle, snood, stay, strap, string, strip, tape, tie, truss, frame, scaffold, enclosure, cage, framework, etc.

The terms "normally closed", mechanism in reference to the incubator parts, modules, support, panels, portions, etc., interchangeably refers hereinafter to a state or position of an element connected by a maneuverable connection (in for example a hinge with a spring loaded system). A normally closed state is configured so that the closed position maintains the maneuverable mechanism in a relaxed or resting position. The position of the element will only change following application of force (for example mechanical force), and will always aim to return to its relaxed closed position when the application of force is removed.

The term "normally opened" mechanism in reference to the incubator parts, modules, support, panels, portions, etc., interchangeably refers hereinafter to a state or position of an element connected by a maneuverable connection (in for example a hinge with a spring loaded system). A normally opened state is configured so that the opened position maintains the maneuverable mechanism in a relaxed or resting position. The position of the element will only change following application of force (for example mechanical force), and will always aim to return to its relaxed opened position when the application of force is removed.

The term an "electrical motor powered system" interchangeably refers hereinafter to an automated electrically powered mechanism can engage an automated system for opening and/or closing, or a combination of an automated system with a return spring, or an automated closing and a return on a spring. An opening and/or closing system can contain a default manual operation status when not connected to an electrical source. This mechanism converts electrical power into a mechanical movement. This can be such as an electromechanical mechanism where the motor uses purely mechanical means to open the door: gears, cams, levers and such; electro-hydraulic mechanism where the motor drives a hydraulic pump, which pressurizes the oil in a door closer, which in turn turns the door closer and opens the door; Electro-pneumatic mechanism where the motor drives an air compressor and may be located away from the door. The air pressure is used to drive the operator above the door.

The term "electromagnetic lock" interchangeably refers hereinafter to a mechanism useful for looking the connection between to objects such as panels, a door and a wall, a door and a door frame, etc. An electromagnetic lock, is a locking device that consists of an electromagnet and an armature plate. Typically the electromagnet is connected to the door and the armored plate is connected to the door frame, where the two elements are connected when the door is closed. The electromagnetic lock can be either "fail safe" or "fail secure". A fail-secure locking device remains locked when power is lost. Fail-safe locking devices are unlocked when de-energized. As dipicited in Wikipedia, when the electromagnet is energized, a current passing through the electromagnet creates a magnetic flux that causes the armature plate to attract to the electromagnet, creating a locking action. Because the mating area of the electromagnet and armature is relatively large, the force created by the magnetic flux is strong enough to keep the door locked even under stress. Typically a separate release button that cuts the lock power supply is mounted near the door. This button usually has a timer that, once the button is pressed, keeps the lock unlocked for either 15 or 30 seconds in accordance with fire codes. Additionally a second release is required by fire code. Additionally or alternatively, either a motion sensor or crash bar with internal switch is used to unlock to door on the egress side of the door automatically.

The term "normally deployed" in reference to any of the cart parts, pillar, support, column, interchangeably refers herein after to a description of the state, or position of an element connected in a maneuverable connection (in for example a hinge with a spring loaded system). A normally deployed state means that mechanism for example are in a relaxed or resting position when the element is deployed. The position of the element will only change after application of force (for example mechanical force), and will always return to its relaxed deployed position when the application of force is removed. In an embodiment, for example when the column is maneuverably connected to for example the base, the default position of the column is to stand perpendicular to the base, upon application of horizontal force the column collapses toward for example the cart base, were it can be either at least partially embedded into the base, embedded into a designated placement, collapse on top of the base, or any angle in-between the primary perpendicular position to a horizontal position.

The terms "push to open", "push to close" interchangeably refer hereinafter to a mechanism enabling opening or closing of a panel, a drawer, a door, by pushing the panel, drawer face, the door. This is usually done without utilizing a mounted handle. Further these mechanisms can be concealed within the object (panel). These mechanisms such as "push to open" commercially available from Southco©, or TIP-ON commercially available from Blum Inc.©.

The term "soft closure mechanism" interchangeably refers hereinafter to a mechanism with a buffered, controlled movement providing silent and soft closure, when alternating between open and closed configuration such as "Blumotion" commercially available from Blum Inc.©.

The term "living hinge" interchangeably refers hereinafter to a thin flexible hinge (flexure bearing) made from the same material as the two rigid pieces it connects, and not be an addition of another material, or some other flexible substance. It is typically thinned or cut to allow the rigid pieces to bend along the line of the hinge. This hinge is known for having minimal friction and very little wear, combined with low cost and ease of manufacturing and recycling.

The term "column" refers hereinafter to a support, rod, tripod, stand, mount, frame, easel, stool, pedestal, quadrated, tetrapod, quintuple legged, footing, hold, post, rib, reinforcement, etc. further the column can be made of or constructed of a single piece, multiple pieces, at least partially connected multiple pieces.

The term "plurality" interchangeably refers hereinafter to an integer a, when a>1.

The term "about" refers hereinafter to 20% more or less than the defied value.

The term "MRI-safe", interchangeably refers hereinafter to any device, part, element, component or implant that is completely non-magnetic, non-electrically conductive, and non-RF reactive, eliminating all of the primary potential threats during an MRI procedure.

Reference is now made to FIG. 1A schematically illustrating, in an out of scale manner, an embodiment of the invention. An incubator (100), comprising a deployable MFP (150) providing closed and opened configurations of the incubator. The MFP is reversibly attachable to at least a portion the incubator. In a closed incubator configuration the MFP is integrated into a panel (110) of the incubator. In an embodiment this MFP comprises at least a portion of the incubator face.

Figure 1B:
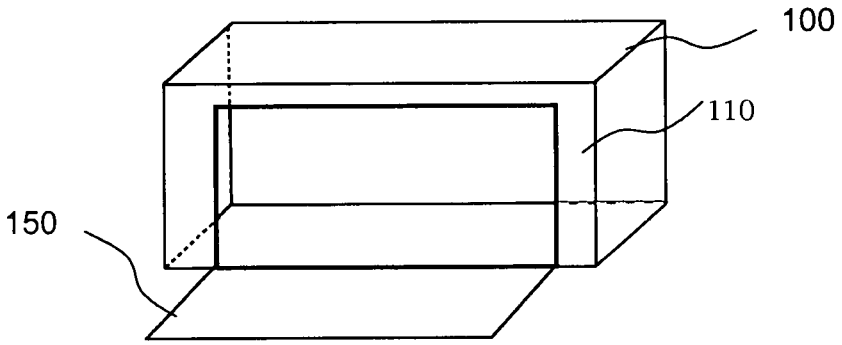

Reference is now made to FIG. 1B schematically illustrating, in an out of scale manner, an embodiment of the invention. An incubator (100), comprising a deployable MFP (150) providing closed and opened configurations. The MFP is maneuverably connected to the incubator. In an opened configuration (FIG. 2B) the MFP (150) folds out and deploys to a planar surface. By remaining open, the neonate accommodated inside the incubator is accessible. The planar surface formed by the MFP in a folded, deployed configuration, comprises at least one life support element.

Figure 2A:
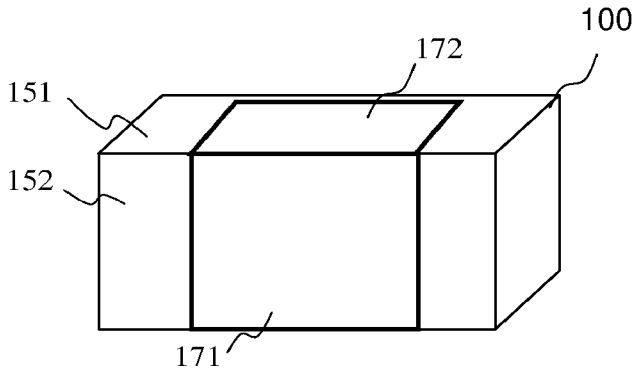
FIGS. 2A and 2B are schematic illustrations of an embodiment of a deployable MFP in an incubator, where the MFP comprises two sections and is integrated into two incubators faces when is closed configuration.

Reference is now made to FIG. 2A schematically illustrating, in an out of scale manner, an embodiment of the invention. A schematic illustrations of an embodiment of an incubator (100), comprising a deployable MFP (150), where the MFP comprises two sections (171, 172) and is integrated into two incubator faces (151, 152) when in closed configuration. In an embodiment the MFP is comprised of multiple sections, integrated into the same or different incubator panels.

Figure 2B:
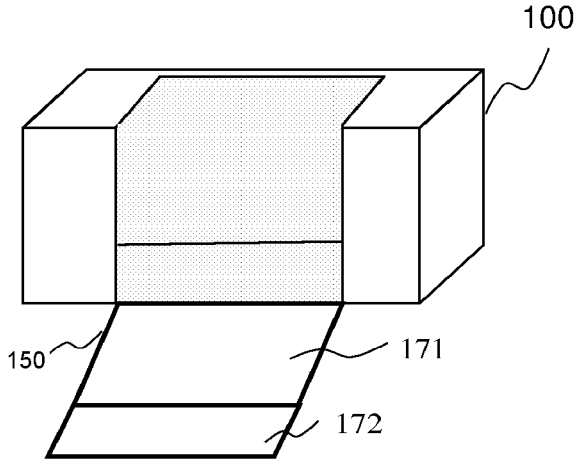

Reference is now made to FIG. 2B schematically illustrating, in an out of scale manner, an embodiment of the invention. A deployable MFP (150) in an incubator (100), providing closed and opened configurations. The MFP is maneuverably connected to the incubator. In an opened configuration (FIG. 2B) the MFP folds out and deploys to at least a partially planar countertop. By remaining open the neonate accommodated inside the incubator is accessible. The planar surface formed by the MFP in a folded, deployed configuration, comprises at least one life support element. In an embodiment the MFP is folded out in at least one step.

Figure 3A:
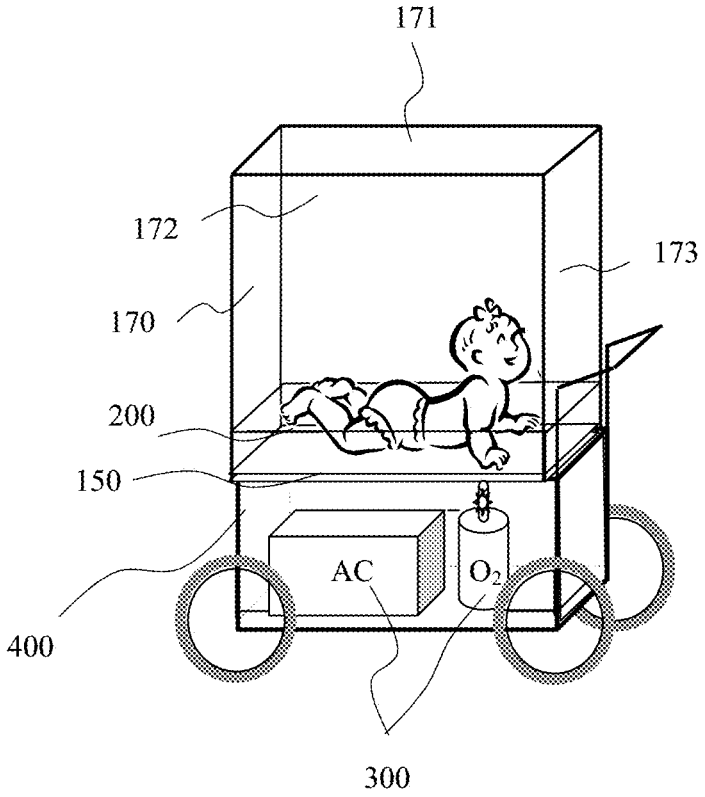
FIGS. 3A and 3B are schematic illustrations of an embodiment of a deployable MFP in an incubator, accommodated upon a mobile cart, in closed and opened configurations.
Figure 3B:
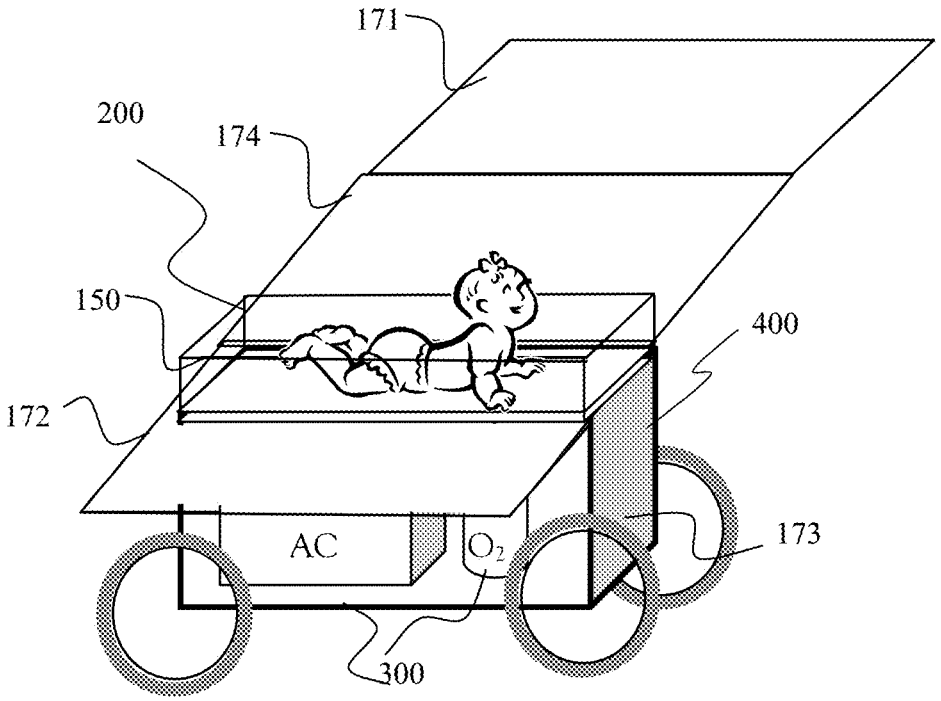

Reference is now made to FIG. 3A schematically illustrating, in an out of scale manner, an embodiment of the invention. An incubator (200), comprising an incubator base (150), further comprising multiple deployable MFPs (170, 171, 172, 173,) providing closed and opened configurations. The MFP is maneuverably connected to the incubator, accommodated upon a mobile cart (400). The cart further accommodates life support systems such as an air condition system and an oxygen tank (300). The planar countertop formed by the MFP in a folded, deployed configuration, comprises at least one life support element Reference is now made to FIG. 3B schematically illustrating, in an out of scale manner, an embodiment of the invention. An incubator (200), comprising multiple deployable MFPs (171, 172, 173 and 174) providing closed and opened configurations. Illustrating an open configuration, where some of the incubator faces (171, 172 and 174) are deployed into a countertop and another incubator panel (173) is folded in a downward direction integrating with a panel of the connected mobile cart (400). The neonate is then placed in an accessible opened configuration in the incubators base (150). The planar surface formed by the MFP in a folded, deployed configuration, comprises at least one life support element.

Figure 3C:
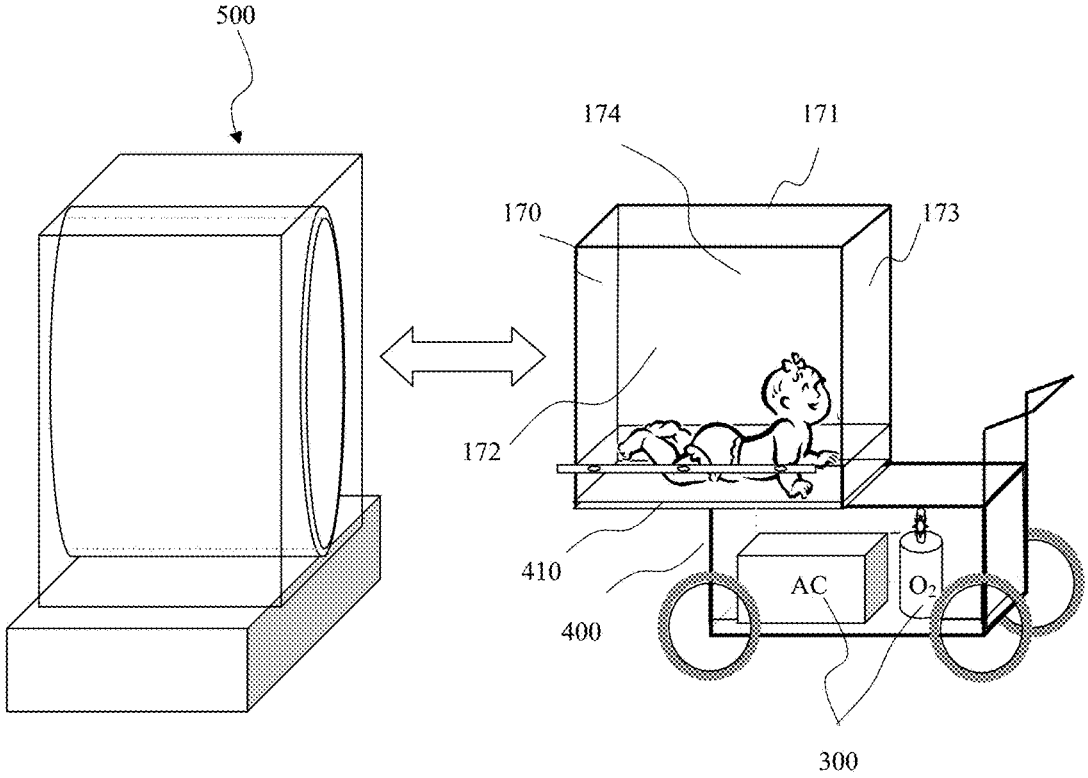
FIG. 3C is a schematic illustration of an embodiment of a deployable MFP in an incubator showing the deployable MFP in closed configuration accommodated upon a mobile cart, having mechanical-means for conveying the incubator into and out of the imaging-device.

Reference is now made to FIG. 3C schematically illustrating, in an out of scale manner, an embodiment of the invention. Deployable multi MFPs (170-174) in an incubator in a closed configuration, accommodated upon a mobile cart (400), having mechanical-means (410) for conveying the incubator into and out of an imaging-device (500). The incubator and the multiple MFPs are comprised of MRI-safe material. The cart at least partially accommodates life support systems (300) such as an air condition system and oxygen tank.

Figure 4:
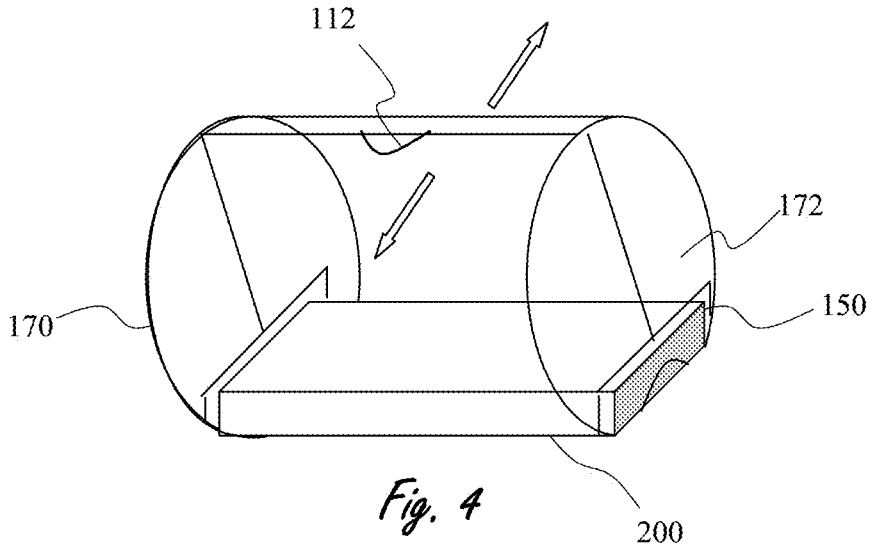
FIG. 4 is a schematic illustration of a cylindered embodiment of a deployable MFP in an incubator.

Reference is now made to FIG. 4 schematically illustrating, in an out of scale manner, an embodiment of the invention. In this embodiment the incubator (200) is in a cylindered shape having an MFP (170) and a non-mobile panel (172). The arrows depict the angle of opening the MFP, while the neonate is placed on a planar surface (150). The MFP comprises a handle (112).

Figure 5:
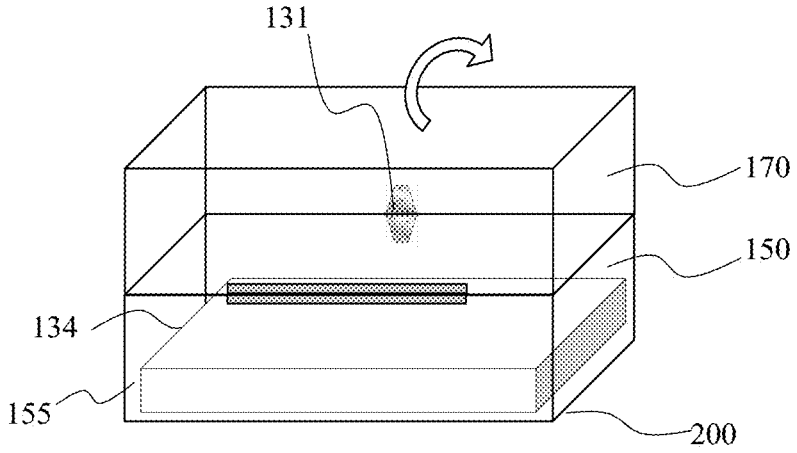
FIG. 5 is a schematic illustration of a rectangular embodiment of a deployable hingedly connected MFP in an incubator.

Reference is now made to FIG. 5 schematically illustrating, in an out of scale manner, an embodiment of the invention. A schematic illustration of a rectangular embodiment of a deployable MFP (170) connected by a hinge in an incubator (200). The connection element (131) is selected from a group consisting of: a hinge, a pivot pin, sliding mechanism, telescopic mechanism, magnetic attachment and any combination thereof. The connection element provides movement provides movement of the MFP (170) in relation to the other incubator faces (150) remaining stable. In an open configuration the incubator base (134) is surrounded by side panels (155). The arrow indicates the opening angle of the MFP in relation the incubator connected with for example a hinge (131).

Figure 6:
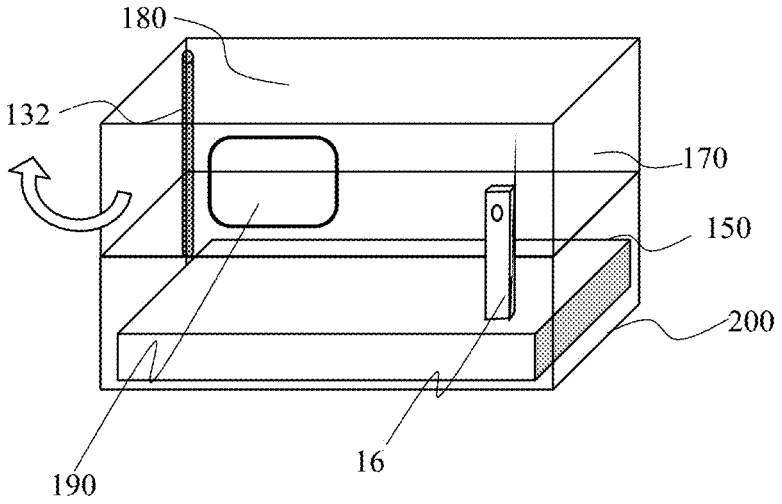
FIG. 6 is a schematic illustration of a rectangular embodiment of a deployable MFP in connected via a pivot point to an incubator.

Reference is now made to FIG. 6 schematically illustrating, in an out of scale manner, an embodiment of the invention. A schematic illustration of a rectangular embodiment of a deployable MFP (180) connected by a pivotal point (132) in an incubator (200). The connection element (132) is selected from a group consisting of: a hinge, a pivot pin, sliding mechanism, telescopic mechanism, magnetic attachment and any combination thereof. The connection element provides movement provides movement of the MFP (180) in relation to the other incubator faces (150) remaining stable. The arrow indicates the opening angle of the MFP in relation the incubator connected with for example a pivot point (132). The MFP (180) comprises a portion of transparent material (190), enabling view of at least a portion of the neonate when the incubator (200) is in closed configuration. Further, the MFP (180) comprises a latching mechanism (16) securing the incubators closed or opened configurations.

Figure 7:
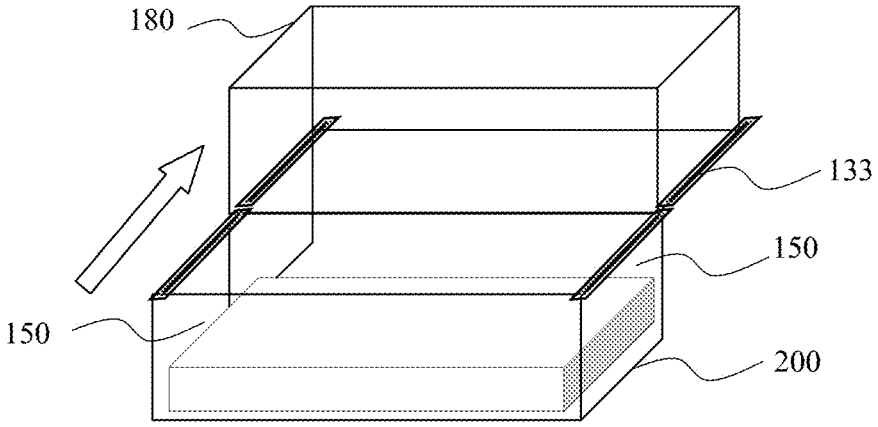
FIG. 7 is a schematic illustration of a rectangular embodiment of a deployable slide able MFP in an incubator.

Reference is now made to FIG. 7 schematically illustrating, in an out of scale manner, an embodiment of the invention. A schematic illustration of a rectangular embodiment of a deployable MFP (180) connected by a sliding mechanism (133) in an incubator (200). The connection element (133) is selected from a group consisting of: a hinge, a pivot pin, sliding mechanism, telescopic mechanism, magnetic attachment and any combination thereof. The connection element provides movement provides movement of the MFP (180) in relation to the other incubator faces (150) remaining stable. The arrow indicates the opening angle of the MFP in relation the incubator connected with for example a sliding mechanism (132).

Figure 8:
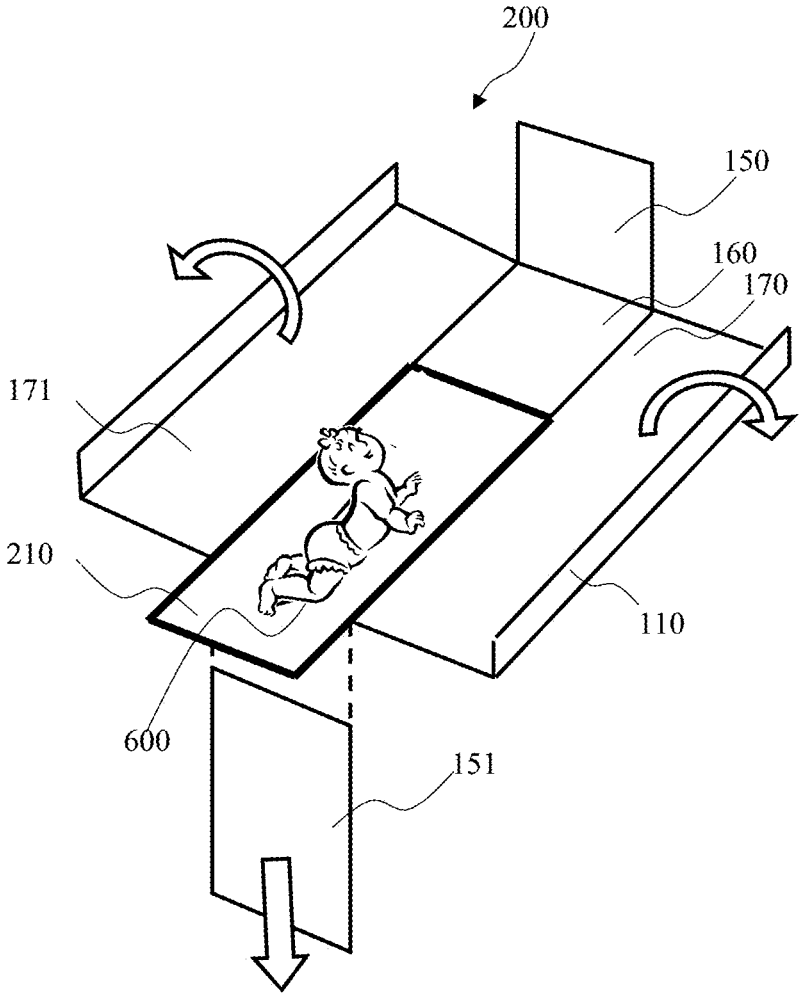
FIG. 8 is a schematic illustration of a rectangular embodiment of multiple deployable MFPs in an incubator.

Reference is now made to FIG. 8 schematically illustrating, in an out of scale manner, an embodiment of the invention. A schematic illustration of a rectangular embodiment of an incubator (200) comprising multiple deployable MFPs (151, 170, 171). In this embodiment two of the MFPs (170, 171) deploy to a horizontal configuration, while MFP (151) deploys towards the bottom to a configuration perpendicular to the floor. The MFPs (170) and (171) contain side panels (110) that can be maneuvered to a perpendicular configuration when MFP is deployed as a countertop. The incubator perpendicular panel (150) remains in configuration. The neonate (600) is placed on a base (210) that can be stationary or completely detached as an independent module. The arrows indicate the direction in which the MFP (170, 171, 151) moves in relation to other incubator faces that remain stationary (150, 160).

Figures 9A, 9B:
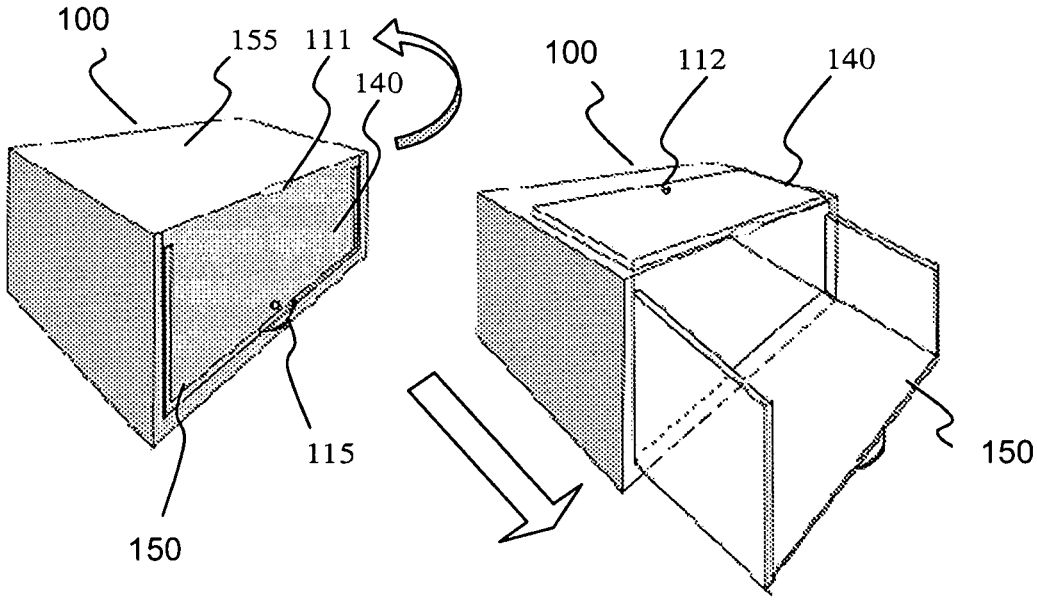
FIGS. 9A and 9B are a schematic illustration of a rectangular embodiment of an MFP deployable as a drawer in an incubator.

Reference is now made to FIGS. 9A and 9B, schematically illustrating, in an out of scale manner, a rectangular embodiment of an MFP (100) deployable as a drawer in an incubator (150). The MFP further comprises a handle for the user. In this embodiment the incubator comprises a second MFP (140) interconnected to the incubator by a hinged connecting element (111) maneuverable towards the top of the incubator (155). This MFP (140) harbors a knob for easy opening. The arrows indicate the direction in which the MFPs are moveable in reference to the stationary parts of the incubator (150).

Figure 10:
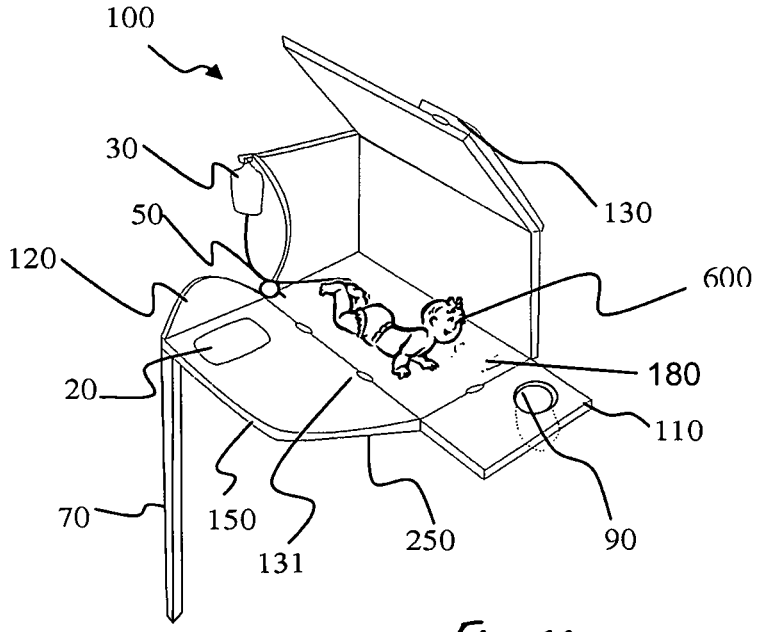
FIG. 10 is a schematic illustration of an embodiment of multiple MFPs in an incubator, comprising a foldable support.

Reference is now made to FIG. 10 schematically illustrating, in an out of scale manner, an embodiment of the invention. In this embodiment the incubator (100) is portrayed deployed in an open configuration, while the neonate (600) is placed in an opened environment, on a stationary base (180). The incubator (100) comprises multi deployable MFPs (110, 120, 130, 150). The MFP can contain an opening connected to a disposable waste container (90). One of the MFPs (130) is held in an opened configuration by magnetic attachment element. Some MFPs remain in a configuration perpendicular to the floor (120) thereby forming a barrier protecting from the accidental fall of objects or patients. Another MFP (150) is maneuverable by a hinged connecting element (131). Further connected to this MFP (150) is a foldable support (70) connecting and stabilizing the MFP to the ground. In this embodiment an MFP (160) comprises medical equipment (30), and a placement for medical equipment tubing (50). Further, an MFP (150) can comprise a placement for sterilized medical treatment tools (20). In addition this embodiment portrays an MFP with a concaved shape (250) providing the handler easy wide access to the neonate when all MFPs of the incubator are fully deployed.

Figure 11:
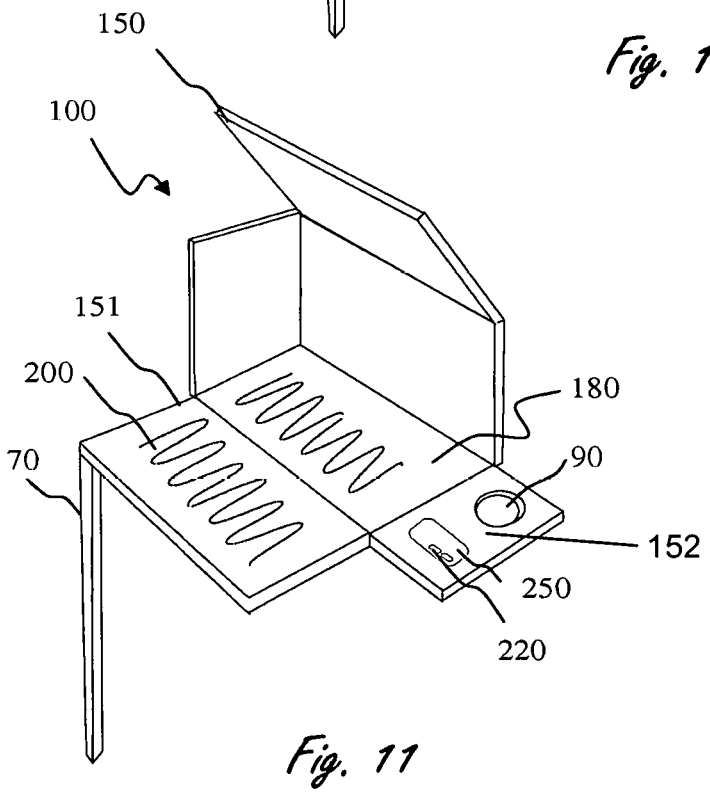
FIG. 11 is a schematic illustration of an embodiment of multiple MFPs in an incubator, integrated with a heating system.

Reference is now made to FIG. 11 schematically illustrating, in an out of scale manner, an embodiment of the invention. A schematic illustration of multiple MFPs (151, 152) in an incubator (100), comprising a foldable leg support (70). In this embodiment, the MFP (151) and the incubator base comprise a temperature regulating system (200) embedded within the panel. Further, the MFP (152) comprises a user interface (250) harboring indicators (220) selected from a group consisting of: visual, auditable and sensory indicators. This MFP (152) further comprises an opening (90) for the connection of exterior systems such as a ventilating system, oxygen supply, neonate when in a closed configuration.

Figure 12:
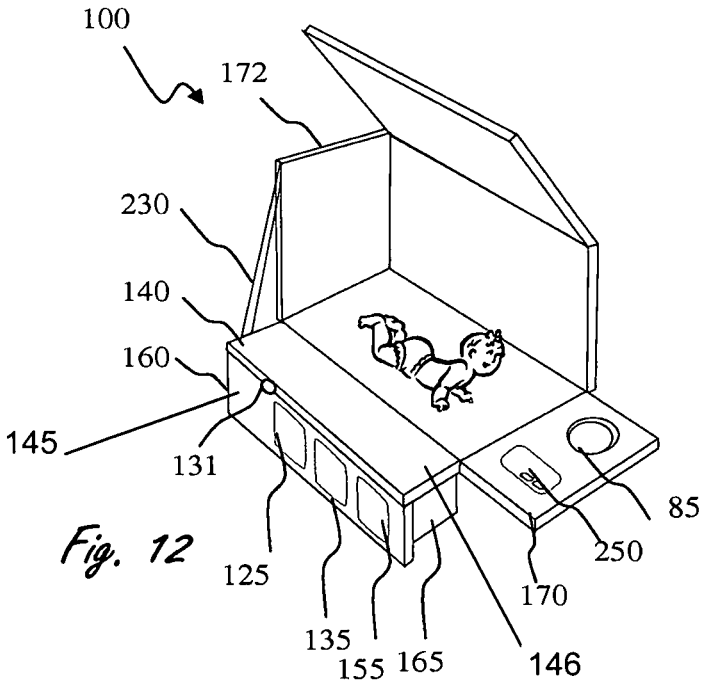
FIG. 12 is a schematic illustration of an embodiment of multiple MFPs in an incubator, comprising a side panel support.

Reference is now made to FIG. 12 schematically illustrating, in an out of scale manner, an embodiment of the invention. A schematic illustration of an incubator (100) showing an embodiment of multiple MFPs. One of the MFP (170) comprises a user interface (250) and at least one opening (85). Another MFP (140) comprises two portions (145, 146) interconnected by a hinge element (131) providing motion there between. The MFP portion (146) is connected to a support element (230) connecting it to an incubator's panel (172). The MFP portion (145) further comprises openings (125, 135, 155) connected to modules (165) such as CPU, disposable waste container, interlock mechanism etc.

Figure 13:
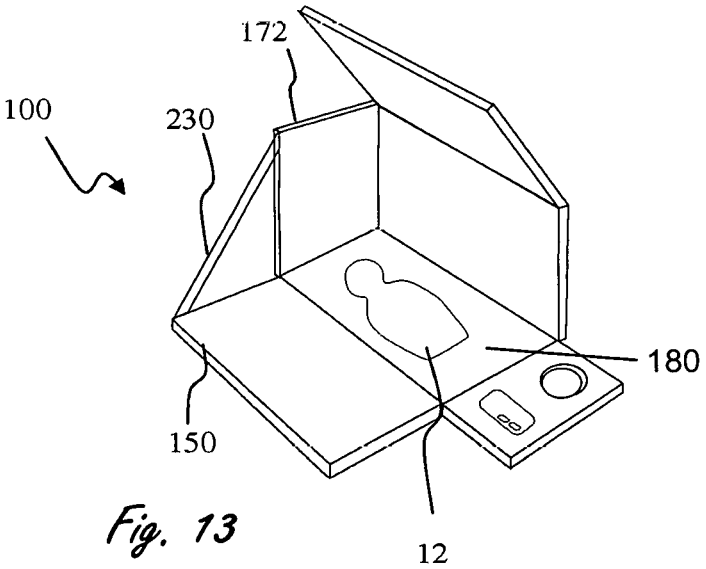
FIG. 13 is a schematic illustration of an embodiment of multiple MFPs in an incubator, comprising an ergonomic placement for a neonate.

Reference is now made to FIG. 13 schematically illustrating, in an out of scale manner, an embodiment of the invention. A schematic illustration of an embodiment of multiple MFPs in an incubator (100), comprising an ergonomic placement for a neonate (12) placed on an incubator panel functioning as a base (180). A support element (230) connects one MFP (150) to another MFP (172).

Figure 14:
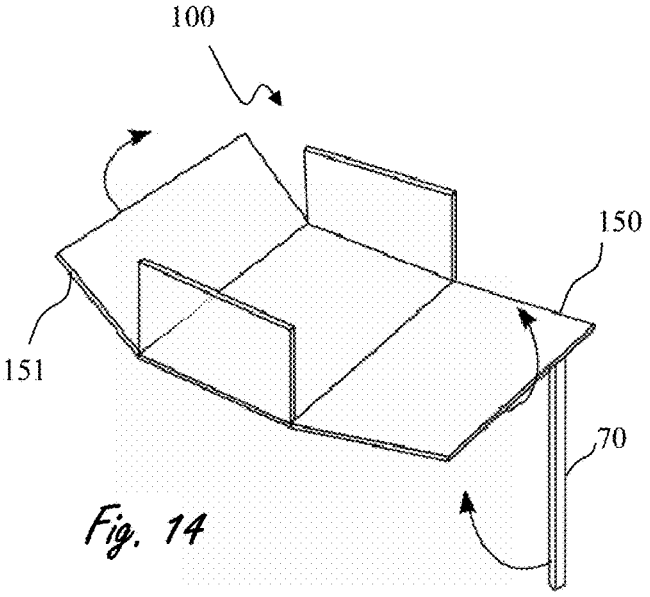
FIG. 14 is a schematic illustration of a part of a deployed incubator having a collapsible column.

Reference is now made to FIG. 14 schematically illustrating, in an out of scale manner, an embodiment of the invention. A schematic illustration of a part of a deployable incubator (100) having multiple MFPs (150, 151). At least one MFP is connected to a collapsible column (70). Arrows A and B indicated the direction of closure for each MFP (151, 150) and arrow C shows the direction of the folding or collapsing of the column providing support to the MFP.

Figure 15:
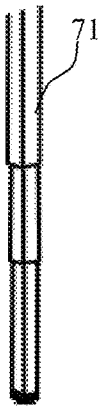
FIG. 15 is a schematic illustration of an embodiment of a part of column having a telescopic mechanism.

Reference is now made to FIG. 15 schematically illustrating, in an out of scale manner, an embodiment of the invention. A schematic illustration of a part of a column (71) having a telescopic mechanism for changing the length of the column, thereby providing adjustment of the height and angle of the MFP.

Figure 16:
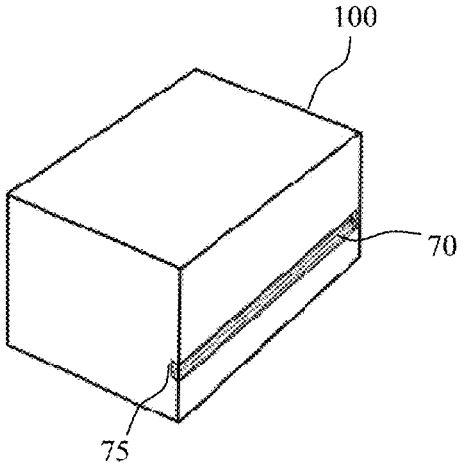
FIG. 16 is a schematic illustration of an embodiment of a deployable incubator having an embedded collapsible column.

Reference is now made to FIG. 16 schematically illustrating, in an out of scale manner, an embodiment of the invention. A schematic illustration showing an embodiment of a column (70) in a folded position, connected to the incubator (100). In this example the column is embedded within at least one incubator panel, in a designated recess (75). The column can be alternatively only partially embedded or placed on top of the panel.

Figure 17:
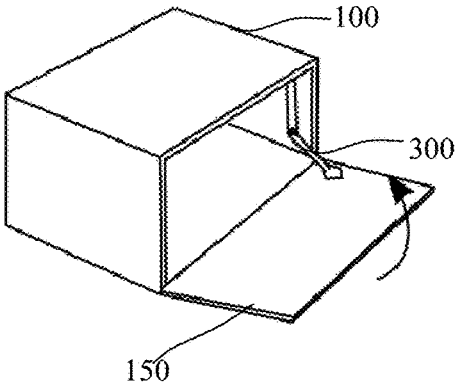
FIG. 17 is a schematic illustration of an embodiment of a deployable incubator having a maneuverable internal mechanism for opening or closing the MFP.

Reference is now made to FIG. 17 schematically illustrating, in an out of scale manner, an embodiment of the invention. A schematic illustration of a deployable incubator (100), having a multifunctional panel (MFP) (150). The panel (150) is connected to a mechanism (300) able to open, close or both the MFP to form a closed environment incubator. The mechanism (300) consists of a hinged arm, and can work as a hydraulic arm, an oil pressure system, a spring system, and etc. Further this mechanism can be within the internal environment of the incubator, on the outside, or any combination thereof.

Figure 18:
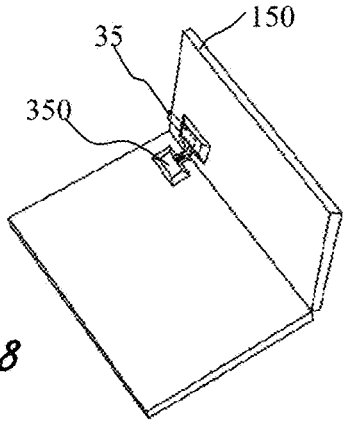
FIG. 18 is a schematic illustration of an embodiment of a part of a deployable incubator having a maneuverable hinge mechanism for opening or closing the MFP.

Reference is now made to FIG. 18 schematically illustrating, in an out of scale manner, an embodiment of the invention. A schematic illustration of a part of a deployable incubator, where the MFP (150) is connected to one of n panels by a hinge mechanism (350) configured to enable opening and closing of the MFP (changing the angle of the MFP relative to one of n panels). This mechanism can be based on a hinge connected to at least one spring, further this mechanism can be a soft close or soft open mechanism. In an embodiment the mechanism has at least two predetermined resting positions, for example in a closed or opened position when the MFP is deployed as a life supporting countertop. The mechanism can be further connected by a series of levers to an external operating interface (35) such as a button or handle. This enables the handler to open the MPF from another location. Additionally or alternatively, this mechanism can be controlled by an electrical locking system, a magnet or a push to open mechanism.

Figure 19:
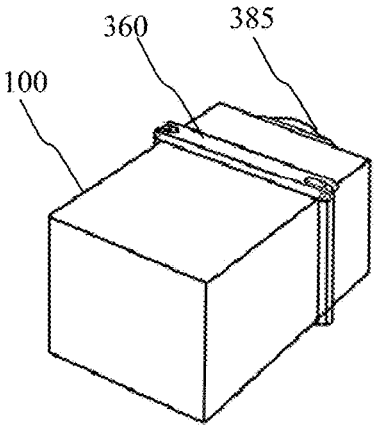
FIG. 19 is a schematic illustration of an embodiment of a deployable incubator having an external opening mechanism.

Reference is now made to FIG. 19 schematically illustrating, in an out of scale manner, an embodiment of the invention. A schematic illustration representing a deployable incubator (100) connected to an external arm (360) providing means for opening, closing or both at least one panel of the deployable incubator. This mechanism can be configured to receive a signal in a designated receiver (385) and further this signal to a CPU controlling the movement of the connected arm. This mechanism includes an engine or any device transforming electrical power to a physical movement.

Figure 20:
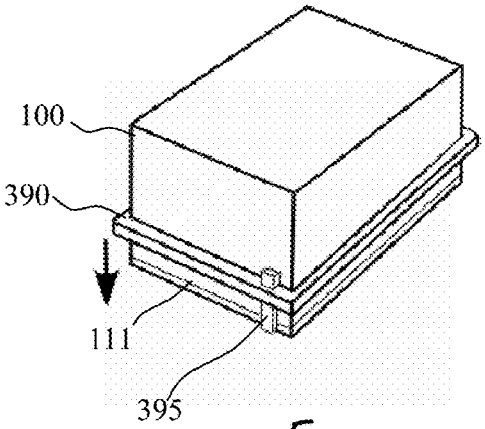
FIG. 20 is a schematic illustration of an embodiment of a deployable incubator having a belt closing and opening mechanism.

Reference is now made to FIG. 20 schematically illustrating, in an out of scale manner, an embodiment of the invention. A deployable incubator (100) having at least one MFP, closed by a vertical motion of a belt (390) along a designated track (395). When the belt is lowered, at least one incubator panel held by the closing force of the belt is released to open pivotally or around a hinge, along the line represented by (111), and contrariwise to close the MFP. The MFP in this embodiment can be a 'normally opened' panel, or a panel maneuverable automatically or manually.

Figure 21:
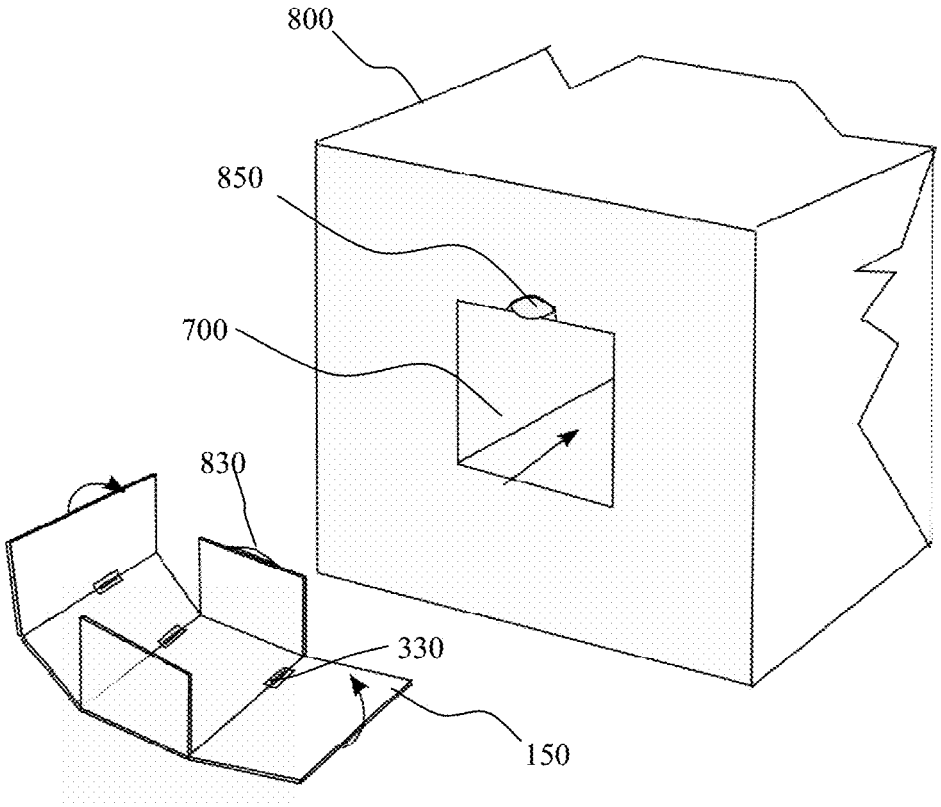
FIG. 21 is a schematic illustration of an embodiment of a magnetic resonance system showing multiple MFPs in a deployable incubator closable when inserted to an MRD.

Reference is now made to FIG. 21 schematically illustrating, in an out of scale manner, an embodiment of the invention. A schematic representation of a device (800), such as an MRD, an ambulance, a transport device, a treatment device, a medical device, etc., having an open bore (700) or an entrance to an inner volume, having a signaling device (850) communicating a signal receivable by a receiver unit (830) placed connected to the deployed incubator. The incubator comprises means to close, open or move to a manual operating system for maneuvering at least one MFP (150) when detecting a signal transmitted by the MRD. The signal and response can be preprogrammed for example to close when the incubator is in proximity to the MRD or other device, and open when in a specific distance, or to operate manually is when absent of a signal, or when receiving a certain signal. The MFP is connected in a maneuverable manner to at least one of n panels, for example by a hinge (330), pivot point, sliding mechanism, magnetic connection and etc.

Figure 22:
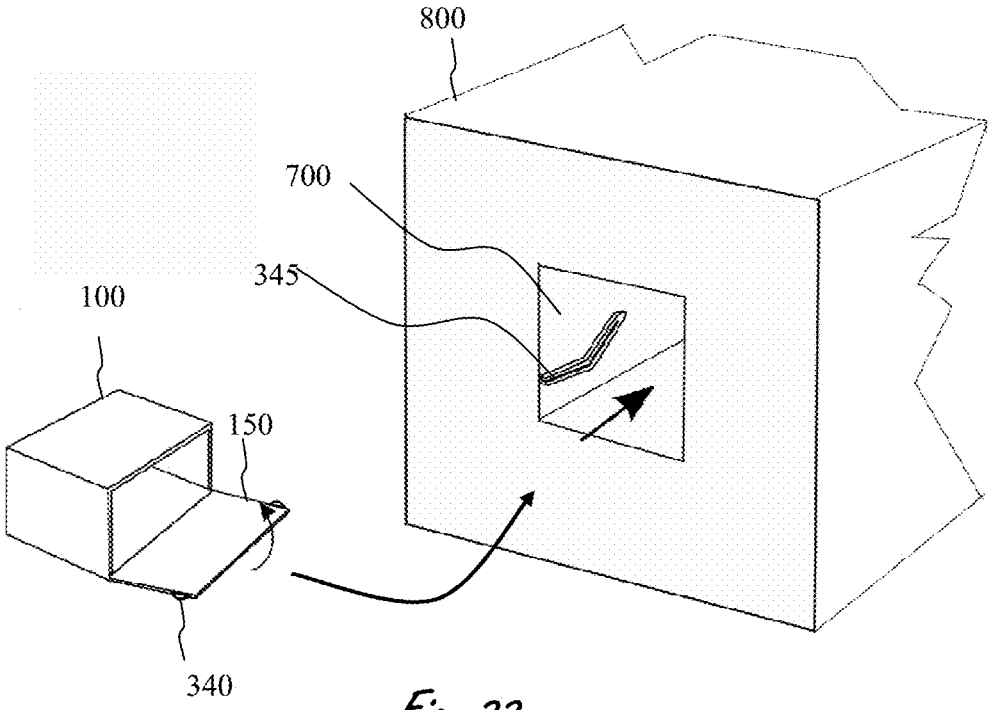
FIG. 22 is a schematic illustration of an embodiment of a magnetic resonance system showing a deployable MFP in an incubator closable when inserted to an MRD having a designated sliding mechanism.

Reference is now made to FIG. 22 schematically illustrating, in an out of scale manner, an embodiment of the invention.

A schematic representation of a device (800), such as an MRD, an ambulance, a transport device, a treatment device, a medical device, etc., having an open bore (700) or an entrance to an inner volume, having a sliding mechanism (345) connected within the circumference of the open bore. The deployable incubator (100), presented in a perspective, comprises at least one MFP (150) having at least one protrusion (340) fitting to be inserted and maneuvered along the device or MRD (800) sliding mechanism (345). Inserting the incubator includes positioning the incubator with the open MFP toward the open bore, so that opposite sides of the MFP are inserted or guided with the sliding mechanism into the device or MRD. The sliding mechanism is configured so that the sliding track (345) is applying force in an angle so that the MFP (150) is maneuvered close an internal environment of the incubator when reaching the end of the track and the incubator is inserted within the device or MRD (800).

What is claimed is:

1. A rectangular incubator, comprising:

a first rectangular stationary multi-functional panel (MFP) having a length and a width, the length and the width sized to accommodate a human neonate;

a second MFP reversibly attached via hinge to the first rectangular stationary MFP along the length of the first rectangular stationary MFP via a first longitudinal edge of the first rectangular stationary MFP, the second MFP having a length equal to the length of the first rectangular stationary MFP the second MFP rotatable about the first longitudinal edge; and a third MFP reversibly attached via hinge to the first rectangular stationary MFP along the length of the first rectangular stationary MFP via a second longitudinal edge of the first rectangular stationary MFP, the third MFP having a length equal to the length of the first rectangular stationary MFP, the third MFP rotatable about the second longitudinal edge, wherein the first rectangular stationary MFP, the second MFP and the third MFP are configured to be in an open configuration and a closed configuration;

wherein the first rectangular stationary MFP, the second MFP and the third MFP form the walls of the rectangular incubator while in the closed configuration;

wherein the second MFP and the third MFP are configured to be rotated from the closed configuration into the open configuration;

wherein while the second MFP and the third MFP are in the open configuration, at least a portion of the second MFP and at least a portion of the third MFP form a planar life supporting countertop with the first rectangular stationary MFP.

2. The rectangular incubator according to claim 1, wherein said rectangular incubator further comprises an opening to accommodate connection of the neonate to life support equipment.

3. The rectangular incubator according to claim 1, wherein said second MFP and said third MFP further comprises at least two sections.

4. The rectangular incubator according to claim 1, wherein said incubator further comprises MRI safe material.

5. The incubator according to claim 1, wherein said incubator further comprises at least one collapsible column configured for supporting said MFP, said column comprising an elongated member having at least two opposite ends, further wherein at least one first end of the column is maneuverably connected to said MFP, and at least one second opposite end of the column is reversibly connected to an element selected from a group consisting of: a cart, a storage unit, a transport device, a wall, a floor, an imaging apparatus, a treatment table, and any combination thereof.

6. The incubator according to claim 5, wherein said column is configured to be normally deployed while said incubator is in an open configuration.

7. The incubator according to claim 5, wherein said column is connected to a mechanism configured to close said MFP while said column is in a collapsed state.

8. The incubator according to claim 5, wherein said column is connected to said MFP by a mechanism configured to collapse said column while said incubator is in a closed configuration.

* * * * *